US009085890B2

(12) United States Patent
Strickland et al.

(10) Patent No.: US 9,085,890 B2
(45) **Date of Patent: *Jul. 21, 2015**

(54) COLLAPSIBLE TRANSPORTABLE STRUCTURES AND RELATED SYSTEMS AND METHODS

(71) Applicant: Rapid Fabrications IP LLC, Sims, NC (US)

(72) Inventors: Joseph George Strickland, Carmel Valley, CA (US); Jack Arthur Paquin, Monterey, CA (US)

(73) Assignee: Rapid Fabrications IP LLC, Sims, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/836,142

(22) Filed: Mar. 15, 2013

(65) Prior Publication Data

US 2013/0305626 A1 Nov. 21, 2013

Related U.S. Application Data

(63) Continuation-in-part of application No. 13/506,659, filed on May 7, 2012, now Pat. No. 8,720,126.

(60) Provisional application No. 61/518,443, filed on May 5, 2011.

(51) Int. Cl.

| | |
|---|---|
| ***E04B 1/344*** | (2006.01) |
| ***E04B 1/343*** | (2006.01) |
| *E04H 1/12* | (2006.01) |

(52) U.S. Cl.

CPC ..... *E04B 1/34384* (2013.01); *E04B 1/3442* (2013.01); *E04B 1/34357* (2013.01); *E04H 2001/1283* (2013.01)

(58) Field of Classification Search

CPC ... E04B 1/344; E04B 1/3442; E04B 1/34384; E04B 1/34357; E04H 2001/1283

USPC ..... 52/69–71, 79.5, 79.12, 143

See application file for complete search history.

(56) References Cited

U.S. PATENT DOCUMENTS

| | | | | |
|---|---|---|---|---|
| 2,780,844 | A | 2/1957 | Bolt | |
| 4,007,833 | A | 2/1977 | Bigelow | |
| 4,534,141 | A * | 8/1985 | Fagnoni | 52/68 |
| 4,891,919 | A | 1/1990 | Palibroda | |

(Continued)

FOREIGN PATENT DOCUMENTS

| | | | |
|---|---|---|---|
| BR | PI0616408 | * | 6/2001 |
| EP | 0 127 070 | | 5/1984 |

(Continued)

*Primary Examiner* — Robert Canfield

(74) *Attorney, Agent, or Firm* — Myers Bigel Sibley & Sajovec, PA

(57) ABSTRACT

A method for rapidly deploying and erecting a HUD-certified structure includes providing an ISO-certified container. The container includes a container frame including a horizontal floor section, an opposed horizontal roof section and first and second opposed vertical end sections, and a pair of opposed vertically-disposed floor panels. The container frame and the opposed floor panels define an interior cavity with a plurality of dwelling members disposed therein. The method further includes transporting the ISO-certified container to a desired location and forming a HUD-certified structure at the desired location, including manipulating at least some of the dwelling members.

20 Claims, 27 Drawing Sheets

(56) References Cited

U.S. PATENT DOCUMENTS

| | | | | |
|---|---|---|---|---|
| 4,912,891 | A | 4/1990 | Bertrand | |
| 5,237,784 | A | 8/1993 | Ros | |
| 5,444,944 | A | 8/1995 | Roelofsz | |
| 5,596,844 | A | 1/1997 | Kalinowski | |
| 5,761,854 | A | 6/1998 | Johnson et al. | |
| 5,890,341 | A | 4/1999 | Bridges et al. | |
| 6,223,479 | B1 | 5/2001 | Stockli | |
| 6,772,563 | B2 | 8/2004 | Kuhn | |
| 6,789,361 | B1 | 9/2004 | Spartz et al. | |
| 6,983,567 | B2 | 1/2006 | Ciotti | |
| 7,290,372 | B2 | 11/2007 | Aust et al. | |
| 7,418,802 | B2 | 9/2008 | Sarine et al. | |
| 7,784,845 | B2 | 8/2010 | Kim et al. | |
| 7,823,337 | B2 | 11/2010 | Pope | |
| 7,832,151 | B2 | 11/2010 | Harrisson et al. | |
| 7,841,136 | B2 | 11/2010 | Czyznikiewicz | |
| 7,874,107 | B1 | 1/2011 | Medley et al. | |
| 7,882,659 | B2 | 2/2011 | Gyory et al. | |
| 8,112,943 | B2 | 2/2012 | Medley et al. | |
| 8,141,304 | B2 | 3/2012 | Shen et al. | |
| 8,166,715 | B2 | 5/2012 | De Azambuja | |
| 8,286,391 | B2 * | 10/2012 | Yang et al. | 52/69 |
| 8,347,560 | B2 | 1/2013 | Gyory et al. | |
| 2002/0116878 | A1 * | 8/2002 | Ciotti | 52/64 |
| 2005/0044804 | A1 * | 3/2005 | Bin et al. | 52/79.5 |
| 2006/0225371 | A1 * | 10/2006 | Shanni | 52/79.5 |
| 2007/0107321 | A1 | 5/2007 | Sarine et al. | |
| 2009/0217600 | A1 | 9/2009 | De Azambuja | |
| 2010/0050540 | A1 * | 3/2010 | Bucher et al. | 52/67 |
| 2010/0064601 | A1 | 3/2010 | Napier | |
| 2010/0147842 | A1 | 6/2010 | Reynard et al. | |
| 2010/0218436 | A1 | 9/2010 | Colquhoun | |
| 2011/0126479 | A1 * | 6/2011 | Alford et al. | 52/79.5 |
| 2012/0006369 | A1 * | 1/2012 | Cantin et al. | 135/96 |
| 2012/0060430 | A1 | 3/2012 | Laprise et al. | |
| 2012/0151851 | A1 | 6/2012 | Cantin et al. | |
| 2012/0255240 | A1 | 10/2012 | Shen | |
| 2013/0014450 | A1 | 1/2013 | Esposito | |
| 2013/0019913 | A1 * | 1/2013 | Zadok et al. | 135/96 |
| 2013/0074424 | A1 | 3/2013 | Trascher et al. | |

FOREIGN PATENT DOCUMENTS

| | | | | |
|---|---|---|---|---|
| EP | 127070 | A2 * | 12/1984 | E04B 1/343 |
| EP | 0604765 | A1 * | 3/2007 | |
| FR | 2557620 | A1 * | 7/1985 | |
| WO | 8604630 | A1 * | 8/1986 | |
| WO | WO 2007033498 | A1 * | 3/2007 | B60P 3/34 |

* cited by examiner

COLLAPSIBLE TRANSPORTABLE STRUCTURES AND RELATED SYSTEMS AND METHODS

RELATED APPLICATIONS

This application is a continuation-in-part application of U.S. patent application Ser. No. 13/506,659, filed May 7, 2012, which claims the benefit of and priority to U.S. Provisional Patent Application No. 61/518,443, filed May 5, 2011, the disclosures of which are incorporated herein by reference as if set forth in their entireties.

FIELD

The present invention relates to structures and, more particularly, to transportable and expandable structure assemblies and systems and methods related thereto.

BACKGROUND

Natural disasters are on the rise. There is an increasing need for emergency assemblies that may be rapidly deployed to the disaster sites and quickly manipulated to form a habitable structure. Such structures may be used for homes, schools, medical care facilities, and so forth. It will be appreciated that such structures may be useful in other applications, such as military operations and temporary work locations (e.g., oil fields).

Emergency structures have been proposed. However, existing emergency structures are not efficiently transportable and/or do not provide for a habitable and robust structure.

It is important that the assembly be certified by the appropriate organization such as the International Organization for Standardization (ISO) such that the assembly is ready to transport the moment it is needed. Thus, embodiments of the present invention are directed to containers that include dwelling members therein, with the container meeting ISO standards (i.e., being an ISO container).

It is also important that the assembly be approved or certified by the appropriate entity such as the Department of Housing and Urban Development (HUD) such that, when the container reaches its destination, the dwelling members may be manipulated to form a comfortable, habitable and robust structure. With regard to natural disasters, the Federal Emergency Management Agency (FEMA) now requires emergency housing to be HUD-approved.

SUMMARY

According to a first aspect, embodiments of the invention are directed to a method for rapidly deploying and erecting a HUD-certified structure, the method including: providing an ISO-certified container, the container comprising a container frame including a horizontal floor section, an opposed horizontal roof section and first and second opposed vertical end sections, the container further comprising a pair of opposed vertically-disposed floor panels, wherein the container frame and the opposed floor panels define an interior cavity with a plurality of dwelling members disposed therein; transporting the ISO-certified container to a desired location; and forming a HUD-certified structure at the desired location, wherein forming the HUD-certified structure comprises manipulating at least some of the dwelling members.

The method may include: obtaining ISO certification for the container prior to providing the ISO-certified container; and obtaining HUD approval of the container and the dwelling members disposed therein prior to transporting the ISO-certified container.

In some embodiments, each floor panel has a top end and a bottom end, with the bottom end of each floor panel pivotally connected to a respective opposite lateral side portion of the container frame floor section, and the step of manipulating at least some of the dwelling members includes pivoting the top ends of the floor panels downward and outward such that each floor panel is oriented horizontally and each floor panel top end is spaced-apart from a respective one of the opposite lateral sides of the container frame floor section.

In some embodiments, the plurality of dwelling members includes: a first exterior side wall panel pivotally connected to the top end of the first floor panel and a second exterior side wall panel pivotally connected to the top end of the second floor panel; first and second exterior end wall panels pivotally connected to the container frame adjacent the first vertical end section and third and fourth exterior end wall panels pivotally connected to the container frame adjacent the second vertical end section; a first pivotable interior wall panel pivotally connected to at least one of the first lateral side of the container frame floor and the first lateral side the container frame roof and a second pivotable interior wall panel pivotally connected to at least one of the second lateral side of the container frame floor and the second lateral side of the container frame roof; and a plurality of roofing panels releasably held in the interior cavity of the container.

In some embodiments, the step of manipulating the plurality of dwelling members includes: pivoting the first exterior side wall panel upwardly from the top end of the horizontally disposed first floor panel and pivoting the second exterior side wall panel upwardly from the top end of the horizontally disposed second floor panel such that the first and second exterior side wall panels are vertically disposed; then pivoting the first and second exterior end wall panels outwardly in opposite directions such that a distal end of the first exterior end wall panel is adjacent the first exterior side wall panel and a distal end of the second exterior end wall panel is adjacent the second exterior side wall panel; pivoting the third and fourth exterior end wall panels outwardly in opposite directions such that a distal end of the third exterior end wall panel is adjacent the first exterior side wall panel and a distal end of the fourth exterior end wall panel is adjacent the second exterior side wall panel; pivoting the first pivotable interior wall panel outwardly such that a distal end thereof is adjacent the first exterior side wall panel and pivoting the second pivotable interior wall panel outwardly such that a distal end thereof is adjacent the second exterior side wall panel; and then attaching the roof panels to top portions of the exterior side wall panels, the exterior end wall panels, the pivotable interior wall panels and/or the container frame roof section.

In some embodiments, the step of manipulating the plurality of dwelling members includes: fixedly engaging the distal end of the first exterior end wall panel to the first exterior side wall panel and/or the first floor panel and fixedly engaging the distal end of the second exterior end wall panel to the second exterior side wall panel and/or the second floor panel; fixedly engaging the distal end of the third exterior end wall panel to the first exterior side wall panel and/or the first floor panel and fixedly engaging the distal end of the fourth exterior end wall panel to the second exterior side wall panel and/or the second floor panel; fixedly engaging the distal end of the first pivotable interior wall panel to the first exterior side wall panel and/or the first floor panel and fixedly engaging the distal end of the second pivotable interior wall panel to the second exterior side wall panel and/or the second floor panel; and fixedly attaching the roof panels to top portions of the exterior side wall panels, the exterior end wall panels, the pivotable interior wall panels and/or the container frame roof section.

In some embodiments, the ISO-certified container has an ISO-certified plaque attached thereto.

According to a second aspect, embodiments of the invention are directed to a container/shelter assembly expandable from a closed container transport state to an expanded habitable state. The assembly includes a container frame including: a horizontal container floor section and an opposed horizontal container roof section; and a first vertical container end section and a second, opposed vertical container end section. The assembly further includes: a first floor panel having a horizontally-extending bottom end and a horizontally-extending top end, the bottom end pivotally connected to a first transverse side of the container floor section; and a second floor panel having a horizontally-extending bottom end and a horizontally-extending top end, the bottom end pivotally connected to a second, opposite transverse side of the container floor section. In the closed container transport state: each of the first and second floor panels are oriented vertically such that the top end of the first floor panel is adjacent a first transverse side of the container roof section and the top end of the second floor panel is adjacent a second, opposite transverse side of the container roof section; an internal cavity is defined by the first and second container end sections, the first and second floor panels, the container floor section and the container roof section; a plurality of dwelling members are disposed in the internal cavity; and the assembly is an ISO-certified container. In the expanded habitable state: the first and second floor panels are pivoted outwardly in opposite directions such that each assumes a horizontal orientation with the top end of each disposed away from an opposite transverse side of the container floor section; and at least some of the plurality of dwelling members are manipulated such that the assembly forms a HUD-certified structure.

In some embodiments, when the first and second floor panels are pivoted outwardly in opposite directions such that each assumes a horizontal orientation with the top end of each disposed away from an opposite transverse side of the container floor section, an upper surface of each floor panel is substantially flush with an upper surface of the container floor section. In some embodiments, the container frame comprises four vertically-extending container corner members, each corner member including an ISO-certified corner fitting at a top and bottom portion thereof.

In some embodiments, the plurality of dwelling members includes a first exterior side wall panel pivotally connected to the top end of the first floor panel via at least one first box hinge and a second exterior side wall panel pivotally connected to the top end of the second floor panel via at least one box hinge, wherein, in the expanded habitable state, each of the first and second exterior side wall panels is pivoted upwardly to form a vertical exterior wall of the HUD-certified structure, and wherein the first and second box hinges are configured to retain the first and second exterior side walls in a vertical orientation.

The plurality of dwelling members may include first, second, third and fourth exterior end wall panels, with each exterior end wall panel having first and second opposing vertically-extending ends, with the first end of each of the first and second exterior end wall panels pivotally connected to the container frame adjacent the first container end section and a respective one of the container corner members, and with the first end of each of the third and fourth exterior end wall panels pivotally connected to the container frame adjacent the second container end section and a respective one of the container corner members. In the closed container state, the first and second exterior end wall panels are oriented substantially perpendicular to the first container end section and the third and fourth exterior end wall panels are oriented substantially perpendicular to the second container end section. In the expanded habitable state, each of the exterior end wall panels is pivoted outwardly such that: the first exterior end wall panel is substantially parallel to the first container end section with the second end of the first exterior end wall panel adjacent the first exterior side wall panel; the second exterior end wall panel is substantially parallel to the first container end section with the second end of the second exterior end wall panel adjacent the second exterior side wall panel; the third exterior end wall panel is substantially parallel to the second container end section with the second end of the third exterior end wall panel adjacent the first exterior side wall panel; and the fourth exterior end wall panel is substantially parallel to the second container end section with the second end of the fourth exterior end wall panel adjacent the second exterior side wall panel. According to some embodiments, in the expanded habitable state: the second ends of the first and third exterior end wall panels are each lockingly engaged with the first exterior side wall panel at spaced-apart locations thereof; and the second ends of the second and fourth exterior end wall panels are each lockingly engaged with the second exterior side wall panel at spaced-apart locations thereof At least some of the exterior end wall panels may include at least one of an ADA-compliant window and an ADA-compliant door.

In some embodiments, the plurality of dwelling members includes first and second pivotable interior wall panels, with each having first and second opposed vertically-extending ends, with the first end of the first pivotable interior wall panel pivotally connected to the first lateral side of at least one of the container floor section and the container roof section, the first end of the second pivotable interior wall panel pivotally connected to the second lateral side of at least one of the container floor section and the container roof section. In the closed container state the first and second pivotable interior wall panels are substantially perpendicular to the first and second container end sections. In the expanded habitable state: the first pivotable interior wall panel is pivoted outwardly so as to be substantially parallel to the first and second container end sections with the second end of the first pivotable interior wall panel adjacent the first exterior side wall panel; and the second pivotable interior wall panel is pivoted outwardly so as to be substantially parallel to the first and second container end sections with the second end of the second pivotable interior wall panel adjacent the second exterior side wall panel. In the expanded habitable state: the second end of the first pivotable interior wall panel may be lockingly engaged with the first exterior side wall panel; and the second end of the second pivotable interior wall panel may be lockingly engaged with the second exterior side wall panel.

The plurality of dwelling members may include a plurality of fixed interior walls, with each of the fixed interior walls fixedly attached to the container floor section, wherein at least some of the fixed interior walls are oriented substantially perpendicular to the first and second container end sections, wherein at least some of the fixed interior walls are oriented substantially parallel to the first and second container end sections, and wherein at least some of the interior walls include an ADA-compliant doorway.

The plurality of dwelling members may include a plurality of roof panels, the roof panels removably held in the interior cavity when the assembly is in the closed container transportable state, and wherein, in the expanded habitable state, the roof panels are attached to upper portions of the exterior side wall panels, the exterior end wall panels, the pivotable interior wall panels and/or the container roof section.

In some embodiments, in the closed transportable container state, the assembly is a sealed ISO-certified container having dimensions of 8 feet wide, 9 feet, six inches tall, and 20, 30 or 40 feet long. In some embodiments, in the closed transportable state, the container has an ISO-certified plaque attached thereto and, in the expanded habitable state, the assembly has a HUD code seal attached thereto. In some embodiments, at least some of the frame, the first and second floor panels, and the dwelling members are pre-wired and/or pre-plumbed, and wherein the assembly includes provisions to connect with a supply source for electricity and/or water.

Further features, advantages and details of the present invention will be appreciated by those of ordinary skill in the art from a reading of the figures and the detailed description of the preferred embodiments that follow, such description being merely illustrative of the present invention.

BRIEF DESCRIPTION OF THE FIGURES

FIG. 9A is a top view of two roof panels secured together. FIG. 9B is a sectional view taken along the line 9B-9B of FIG. 9A. FIG. 9C is an enlarged sectional view illustrating the interconnection between adjacent roof panels.

DETAILED DESCRIPTION OF EMBODIMENTS OF THE INVENTION

Figure 1:
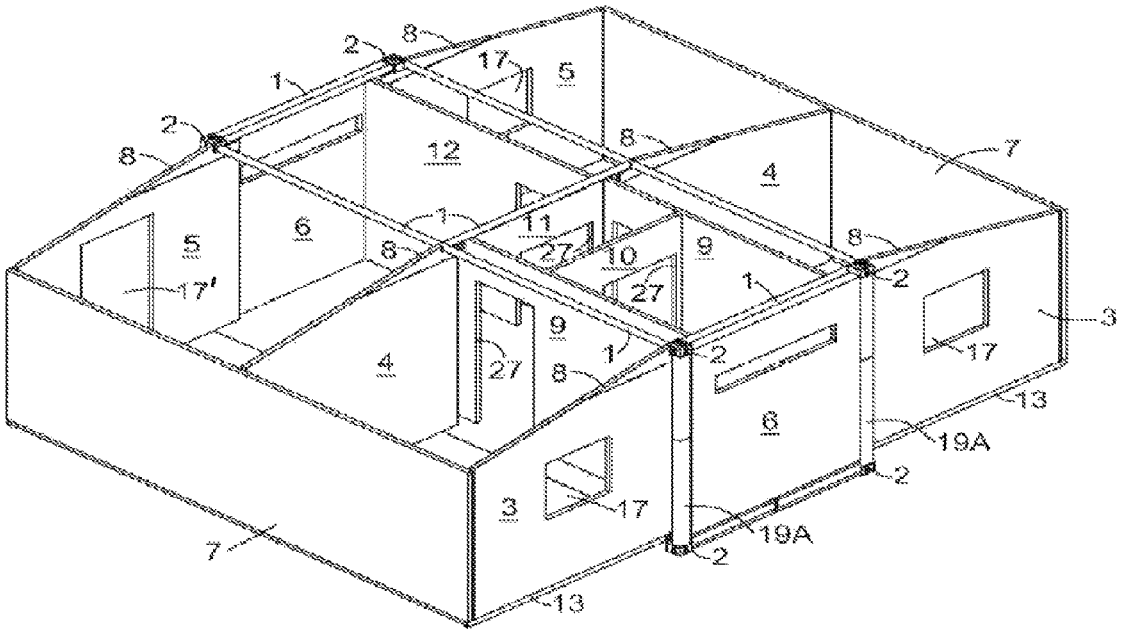
FIG. 1 is a top perspective view of a container/shelter assembly according to some embodiments, with the assembly in an expanded state but with roofing panels removed.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

Figure 7:
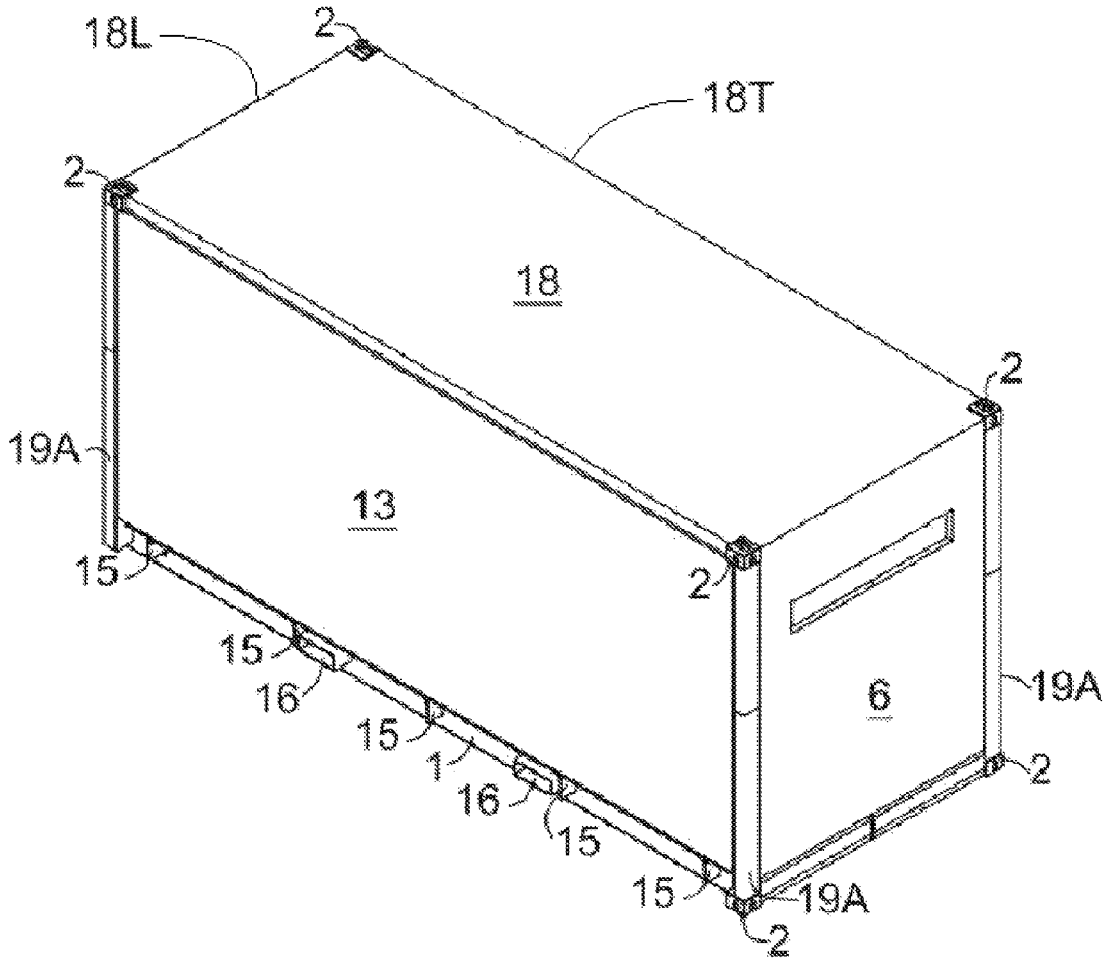
FIG. 7 is a top perspective view of the assembly of FIG. 1 in the closed container state.
Figure 8:
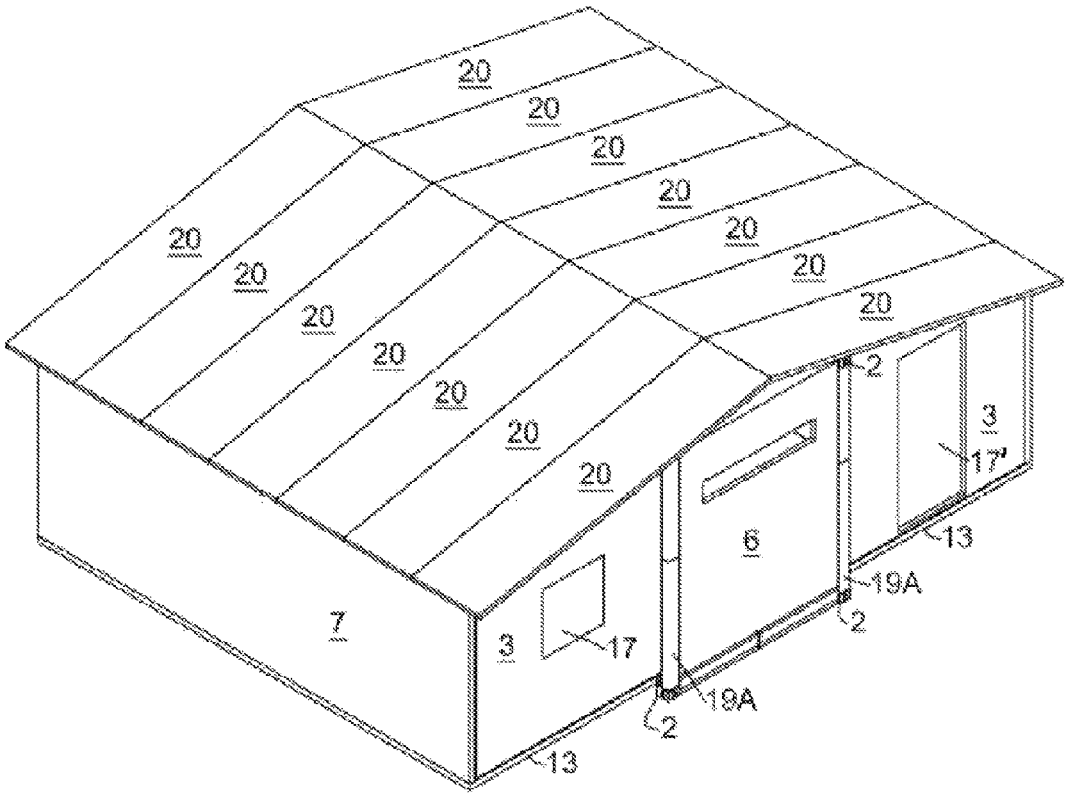
FIG. 8 is a top perspective view of the assembly of FIG. 1 in the expanded habitable state.
Figure 9A:
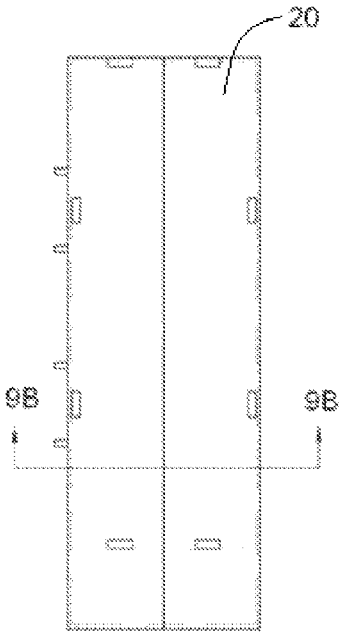
FIGS. 9A-9C illustrate roof panels and associated connections according to some embodiments.
Figure 9B:
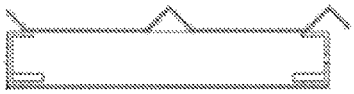
Figure 9C:
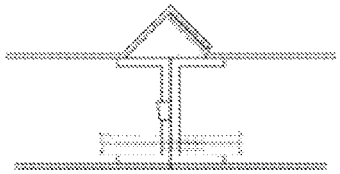

Some embodiments of the invention are directed to "collapsible" or "expandable" container/structure assemblies. In some embodiments, and as illustrated in FIG. 7, container/structure assemblies are provided in a "closed," "container,"

"closed container," "closed container transport" or "transport" mode or state (these terms may be used interchangeably herein). The assembly in this state facilitates transport to a destination by truck, train, plane, ships, helicopters and other modes of transport. In many cases, in order to transport a container by ship, rail, truck or plane, the container must comply with at least one of various safety and handling standards. These standards are regulated by different organizations, International Organization for Standardization (ISO), International Maritime Organization (IMO), International Convention for Safe Containers (CSC), United States Coast Guard (USCG) and others.

In some embodiments, in the closed container state (FIG. 7), the assembly is an ISO certified container. The container is designed and tested to comply with ISO 1496-1:1990, entitled "Series 1 Freight Containers—Specification and Testing," which sets forth the specifications and testing requirements for ISO-compliant freight containers. It will be understood that containers/assemblies according to embodiments of the invention may comply with any equivalent superseding ISO standard.

In some embodiments, in the closed container state (FIG. 7), the assembly is an IMO certified container. The container is designed and tested to comply with IMO MSC/Circ.860 (1998), entitled "Guidelines for the Approval of Offshore Containers Handled in Open Seas." It will be understood that containers/assemblies according to embodiments of the invention may comply with any equivalent superseding ISO standard.

In some embodiments, in the closed container state (FIG. 7), the assembly is CSC certified container. The International Convention for Safe Containers is a 1972 regulation by the Inter-governmental Maritime Consultative Organization on the safe handling and transport of containers. It decrees that every container travelling internationally is supplied with a "CSC-Plate." It will be understood that containers/assemblies according to embodiments of the invention may comply with any equivalent superseding CSC regulation.

In some embodiments, in the closed container state (FIG. 7), the assembly is United States Coast Guard certified container. Specifically, the container complies with 49 CFR §§450.1-453.7, entitled "Safety Approval of Cargo Containers." It will be understood that containers/assemblies according to embodiments of the invention may comply with any equivalent superseding regulations or rules.

Figure 2:
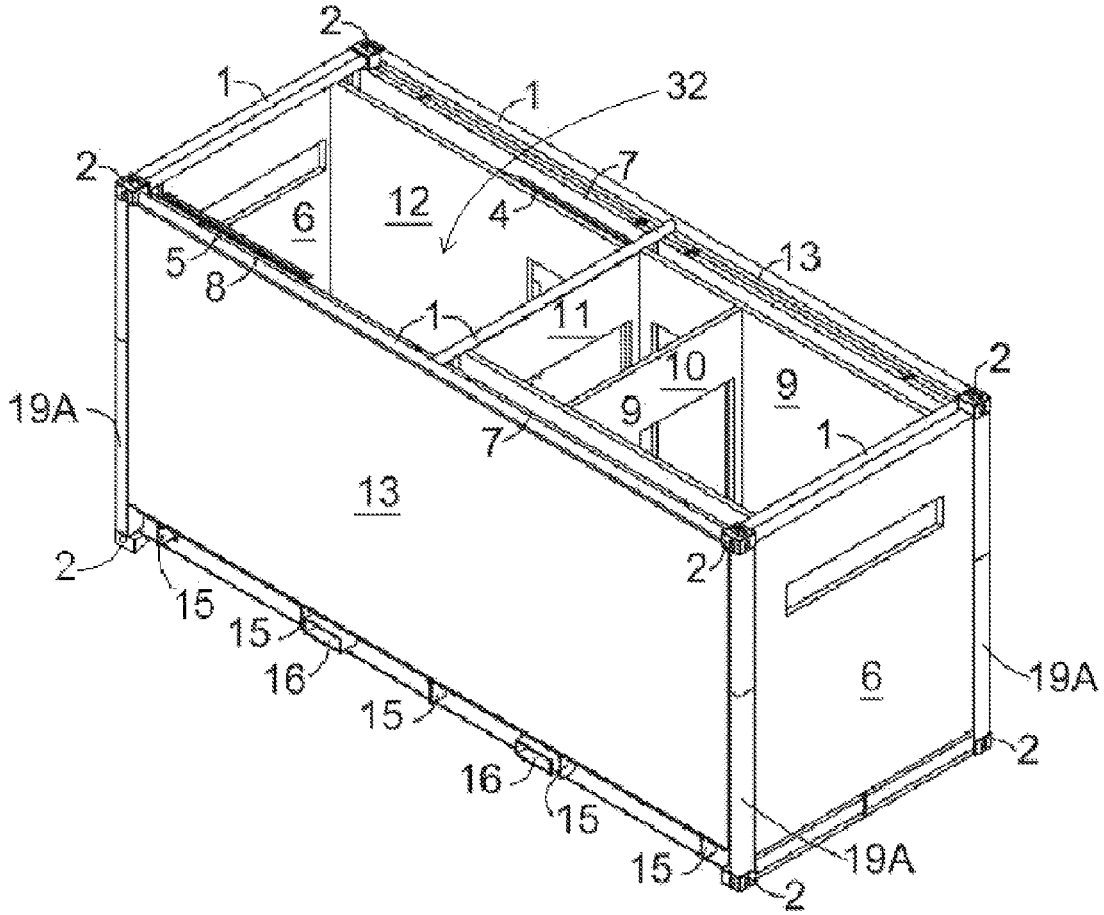
FIG. 2 is a top perspective view of the assembly of FIG. 1, with the assembly in a closed container state but with an upper container roof section removed.
Figure 3:
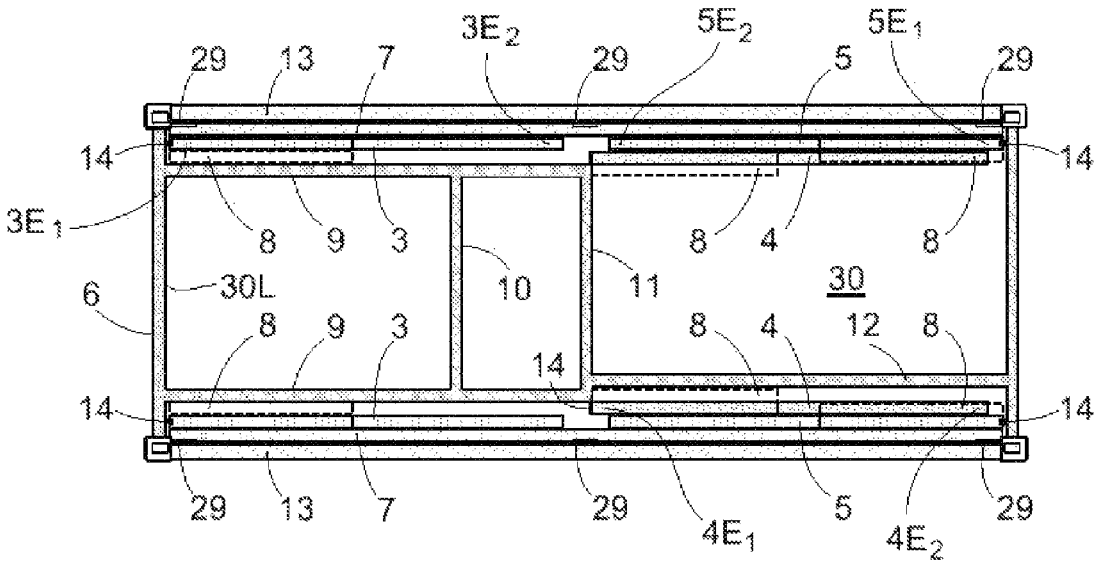
FIG. 3 is a top view of the assembly of FIG. 1, with the assembly in a closed container state but with an upper container roof section removed.
Figure 4:
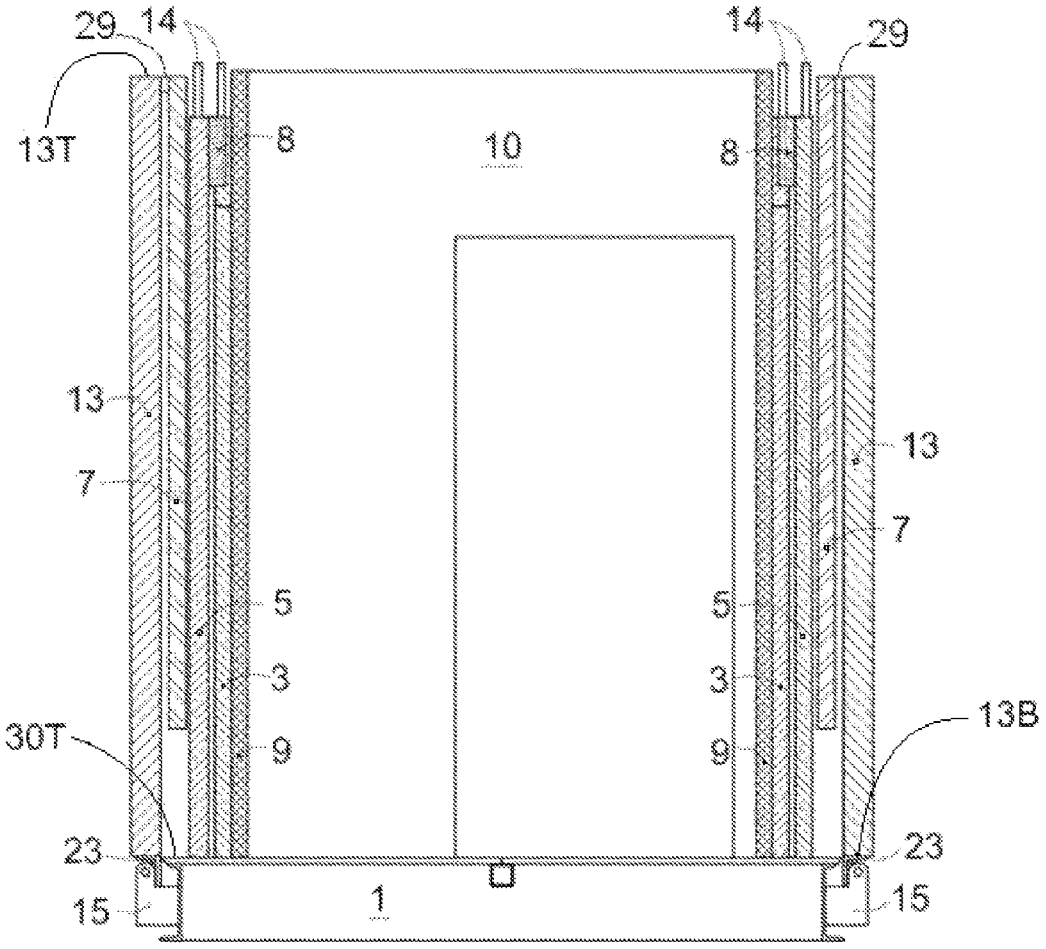
FIG. 4 is a sectional side view of the assembly of FIG. 1, with the assembly in a closed container state but with an upper container roof section removed.

Again, FIG. 7 illustrates the assembly in the closed container state. The assembly includes a frame or mainframe 1 including a horizontal container roof section 18. The container roof section 18 includes first and second opposed longitudinal ends 18L and first and second opposed transverse sides 18T. FIGS. 2 and 3 illustrate the assembly with the roof section 18 removed. FIG. 4 is a sectional view with the container roof section 18 removed. The frame 1 includes a horizontal container floor section 30 (FIG. 3) that is disposed opposite the container roof section 18. The container floor section 30 includes first and second opposed longitudinal ends 30L (FIG. 3) and first and second opposed transverse sides 30T (FIG. 4).

The frame 1 includes first and second opposed vertical container end sections 6. The first vertical container end sections 6 is attached to the first container roof section longitudinal end 18L and to the corresponding first container floor section longitudinal end 30L. The second vertical container end section 6 is attached to the second container roof section longitudinal end 18L and to the corresponding second container floor section longitudinal end 30L.

The assembly includes first and second floor panels 13. Each floor panel 13 has a horizontally-extending bottom end 13B and a horizontally-extending top end 13T (FIG. 4). The bottom end 13B of the first floor panel 13 is pivotally connected to the first transverse side 30T of the container floor section 30, as described in more detail below. The bottom end 13B of the second floor panel 13 is pivotally connected to the second, opposite transverse side 30T of the container floor section 30, as will also be described in greater detail below.

With the assembly in the closed container state, each of the first and second floor panels 13 is oriented vertically such that the top end 13T of the first floor panel 13 is adjacent the first transverse side 18T of the container roof section 18 and the top end 13T of the second floor panel 13 is adjacent the second, opposite transverse side 18T of the container roof section 18 (FIGS. 4 and 7).

As illustrated in FIG. 2, the container frame 1 includes four vertically-extending container corner members 19A. Each corner member 19A may include including a corner fitting 2 at a top and bottom portion thereof. In some embodiments, each corner fitting 2 is an ISO-certified corner fitting. In some embodiments, and as illustrated in FIGS. 2 and 7, forklift openings 16 may be provided on either side of the frame 1. The forklift openings 16 may be useful to load the assembly for shipping and/or to position the assembly after it has reached its destination.

Therefore, in some embodiments, the horizontal container floor section 30 extends between the bottom portions of the corner members 19A and the horizontal container roof section 18 extends between the top portions of the corner members 19A. In some embodiments, the first vertical container end section 6 extends between one pair of the corner members 19A and the second, opposed vertical container end section 6 extends between the other pair of the corner members.

An internal cavity 32 is defined by the first and second container end sections 6, the first and second floor panels 13, the container floor section 30 and the container roof section 18. For clarity, the internal cavity 32 is illustrated in FIG. 2 with the container roof section 18 removed.

A plurality of dwelling members are disposed in the internal cavity 32 with the assembly in the closed container state. The dwelling members may include first and second exterior side wall panels 7. The first exterior side wall panel 7 may be pivotally connected to the top end 13T of the first floor panel 13 via at least one first box hinge 29 (FIG. 3). Similarly, the second exterior side wall panel 7 may be pivotally connected to the top end 13T of the second, opposite floor panel 13 via at least one box hinge 29 (FIG. 3). As illustrated, each exterior side wall panel 7 may be pivotally connected to the top end 13T of a respective floor panel 13 via a plurality of spaced-apart box hinges 29.

The dwelling members may include first and second exterior wall panels 3 and third and fourth exterior end wall panels 5. Each of the first and second exterior end wall panels 3 has first and second opposing vertically-extending ends $3E_1$, $3E_2$ (FIG. 3) and each of the third and fourth exterior end wall panels 5 has first and second opposing vertically-extending ends $5E_1$, $5E_2$. The first end $3E_1$ of each of the first and second exterior end wall panels 3 may be pivotally connected to the container frame 1 adjacent the first container end section 6 and a respective one of the container corner members 19A. The first end $5E_1$ of each of the third and fourth exterior end wall panels 5 may be pivotally connected to the container frame 1 adjacent the second, opposed container end section 6 and a respective one of the container corner members 19A. In the closed container state, the first and second exterior end wall panels 3 may be oriented substantially perpendicular to the first container end section 6 and the third and fourth exterior end wall panels 5 may be oriented substantially perpendicular to the second container end section 6. The first end $3E_1$ of each end wall panel 3 and the first end $5E_1$ of each end wall panel may be pivotally connected via a pivot pin 14 (FIGS. 3 and 4). Each pivot pin 14 may extend along a height of the respective end wall panel 3, 5 or along at least a major portion of a height of the respective end wall panel 3, 5. Each pivot pin 14 may be attached or connected to the frame 1, for example at the container floor portion 30.

In some embodiments, the plurality of dwelling members includes first and second pivotable interior wall panels 4, with each having first and second opposed vertically-extending ends $4E_1$, $4E_2$ (FIG. 3). The first end $4E_1$ of the first pivotable interior wall panel 4 may be pivotally connected to the first lateral side 30L, 18L of at least one of the container floor section 30 and the container roof section 18. Similarly, the first end $4E_1$ of the second pivotable interior wall panel 4 may be pivotally connected to the second, opposite lateral side 30L, 18L of at least one of the container floor section 30 and the container roof section 18. In some embodiments, in the closed container state, the first and second pivotable interior wall panels 4 are substantially perpendicular to the first and second container end sections 6. In some embodiments, the first end $4E_1$ of each of the first and second pivotable interior walls 4 extends at least a major distance between the container floor section 30 and the container roof section 18.

The plurality of dwelling members may include a plurality of fixed interior walls 9, 10. In some embodiments, each of the fixed interior walls 9, 10, 11, 12 is fixedly attached to the container floor section 30.

Figure 23:
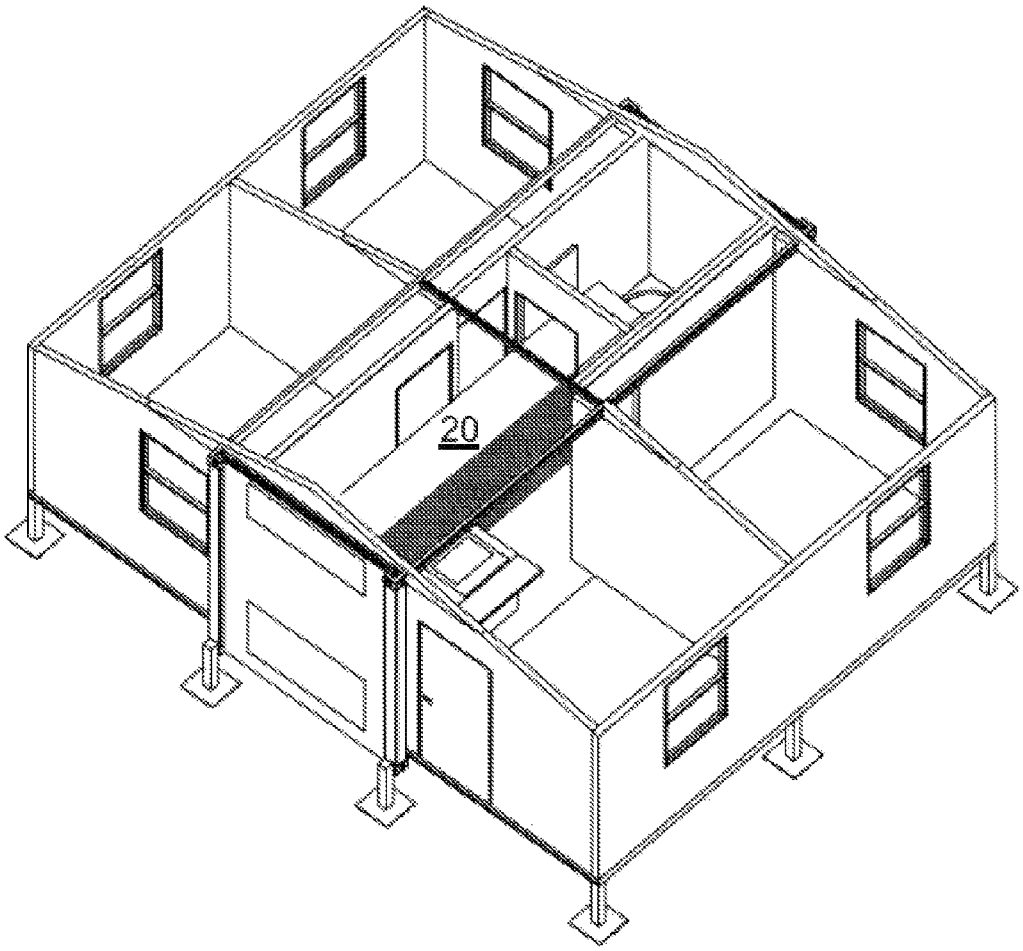

In some embodiments, the plurality of dwelling members includes a plurality of roof panels 20 (FIG. 23). The roof panels 20 may be removably held in the interior cavity when the assembly is in the closed container transportable state.

At least some of the floor panels 13, the exterior side wall panels 7, the exterior end wall panels 3, 5, the pivotable interior wall panels 4, the fixed interior wall panels 9, 10, 11, 12 the container end sections 6, the container floor section 30, the container roof section 18 and the roof panels 20 may be insulated.

Figure 11:
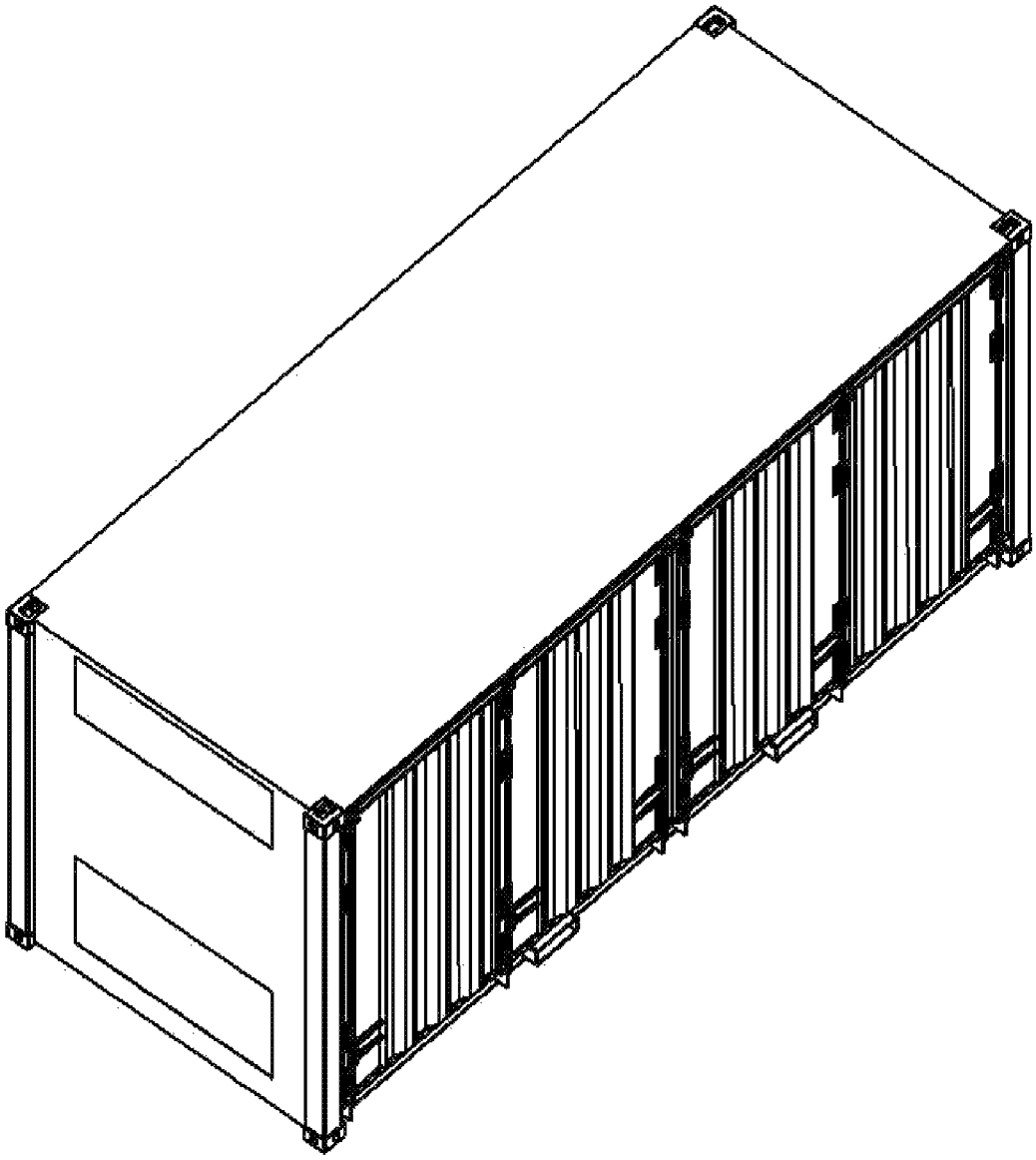
FIGS. 11-25 illustrate an exemplary process for manipulating the assembly of FIG. 1 from the closed container state to the expanded habitable state.

As described above, in the closed transportable container state, the assembly may form a compliant container. For example, as shown in FIG. 11, the assembly may form a sealed ISO-certified container having dimensions of 8 feet wide, 9 feet, six inches tall, and 20, 30 or 40 feet long.

From the closed container state, the assembly may be expandable to an "expanded," "habitable" or "expanded habitable" state, all terms used interchangeably herein. For example, the assembly may be transported to a place of need, such as a disaster area, and then expanded to form a habitable structure. Generally speaking, at least some of the dwelling features may be manipulated to transform the assembly from the container state to the expanded state, as will be described below.

Figure 10:
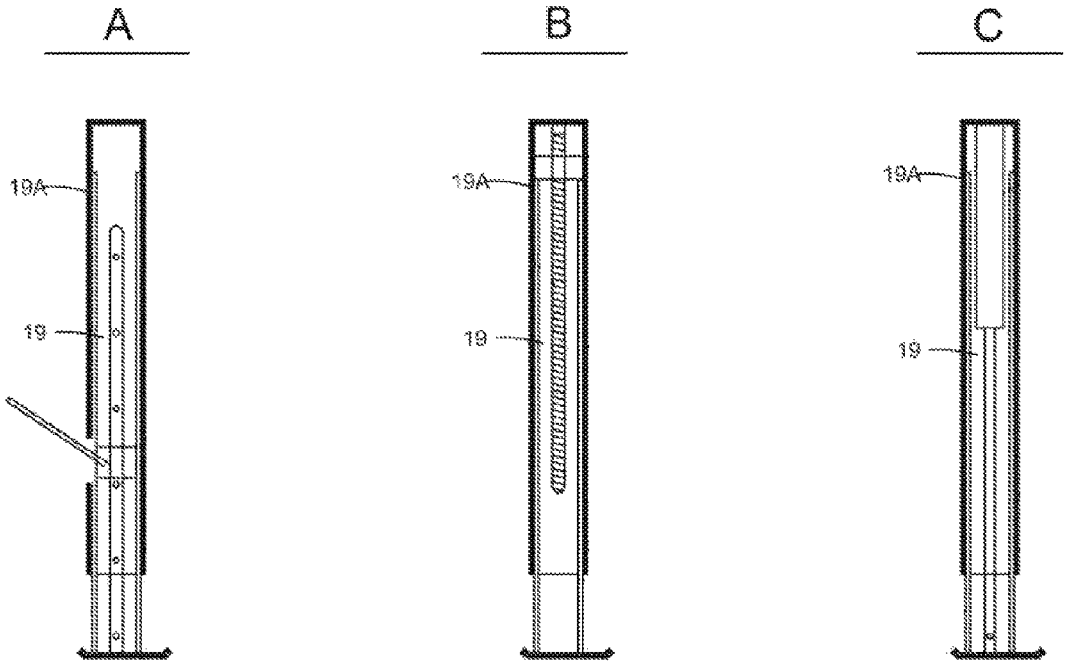
FIG. 10 illustrates various jacks that may be used with the assembly of FIG. 1.
Figure 12:
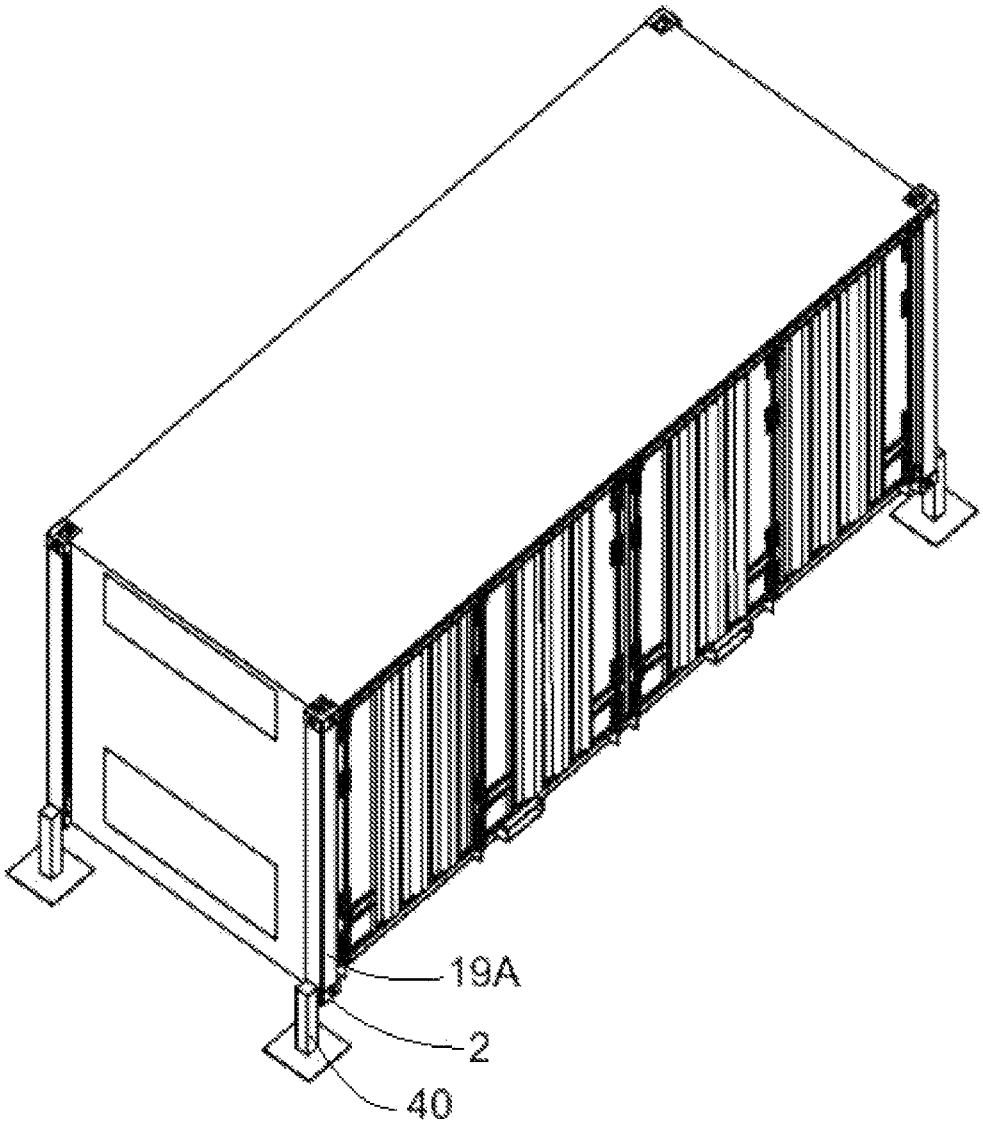

Referring to FIG. 12, a leg 40 may be attached to one or more of the corner members 19A or the lower corner fitting 2. The leg(s) 40 may serve to position the structure off the ground and/or level the structure on uneven ground. In some embodiments, the legs 40 have an adjustable height to facilitate leveling the structure. Additionally or alternatively, the legs 40 may be attached at various heights along the various corner members 19A to facilitate leveling the structure. In some other embodiments, and referring to FIG. 10, one or more of the corner members 19A may include at an inner lower portion thereof a jack 19. The jacks 19 may be mechanical, electrical, hydraulic or pneumatic, for example. The jacks 19 may be actuated to facilitate level placement of the structure.

Figure 5A:
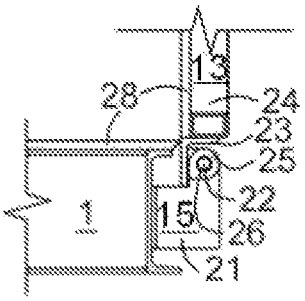
FIGS. 5A-5C illustrate the operation of a pivot hinge of the assembly of FIG. 1.
Figure 5B:
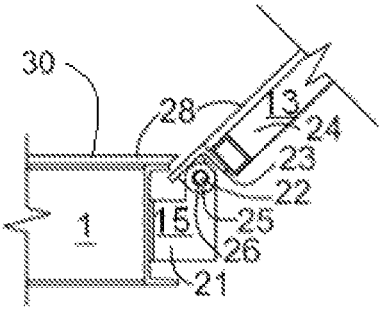
Figure 5C:
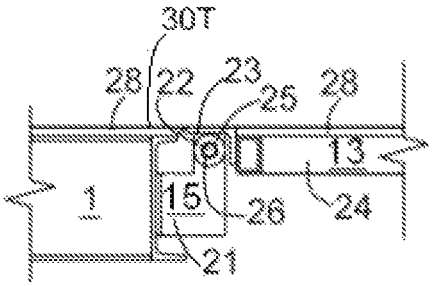
Figure 6:
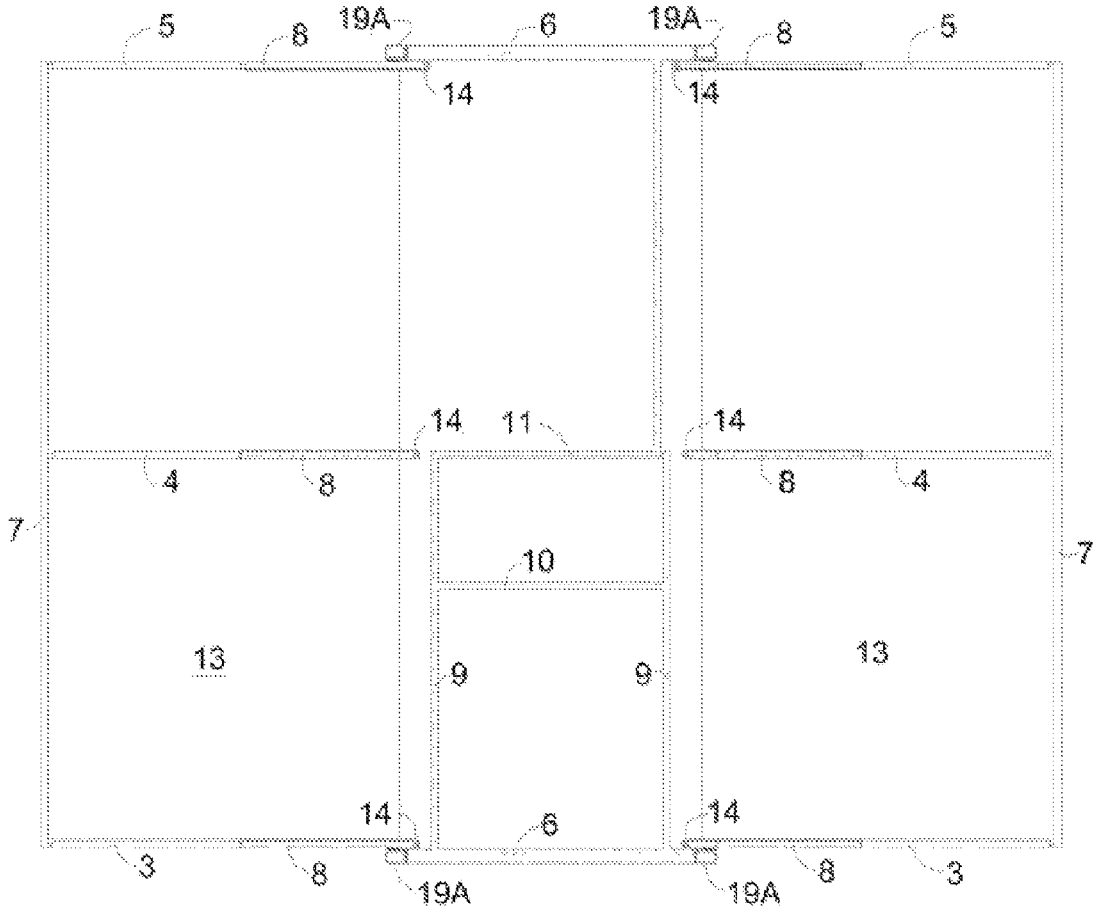
FIG. 6 is a top plan view of a floor plan of the assembly of FIG. 1, with the assembly in an expanded state but with roofing panels removed.
Figure 13:
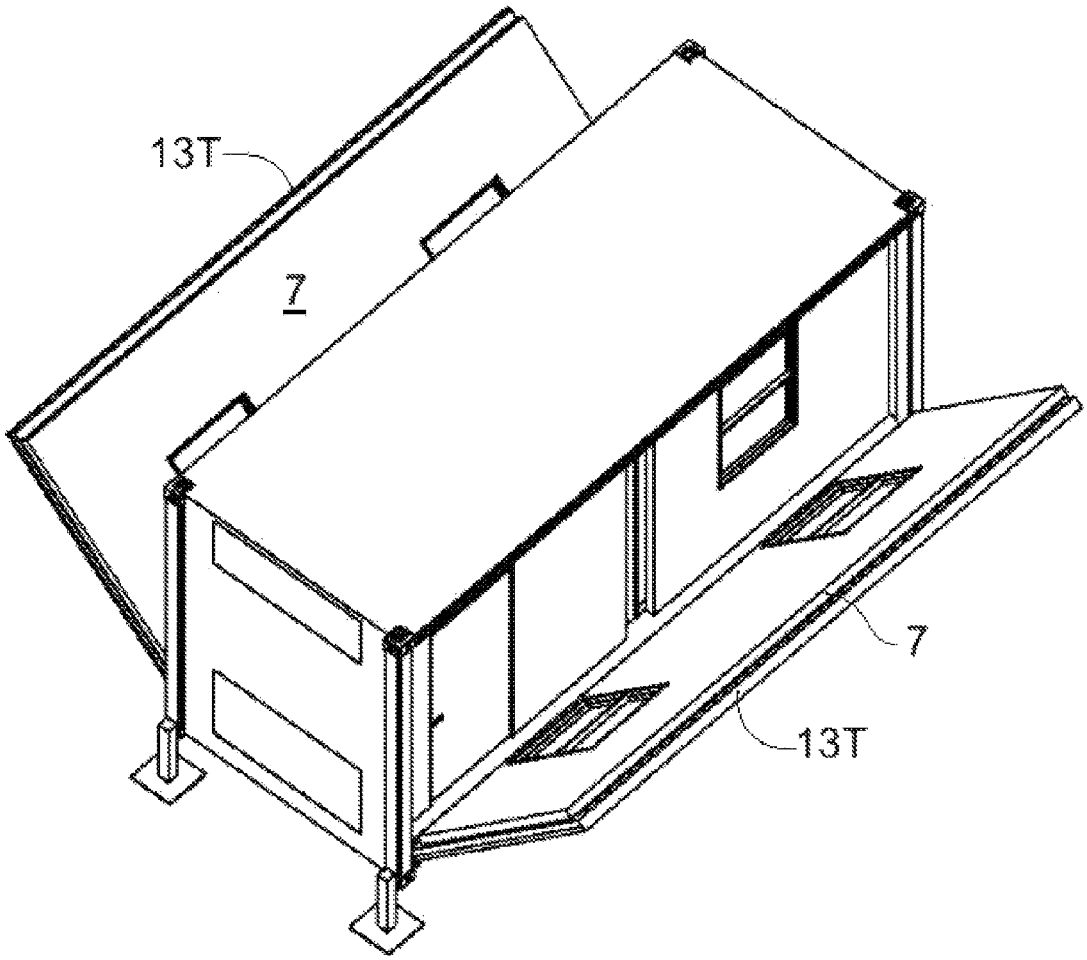
Figure 14:
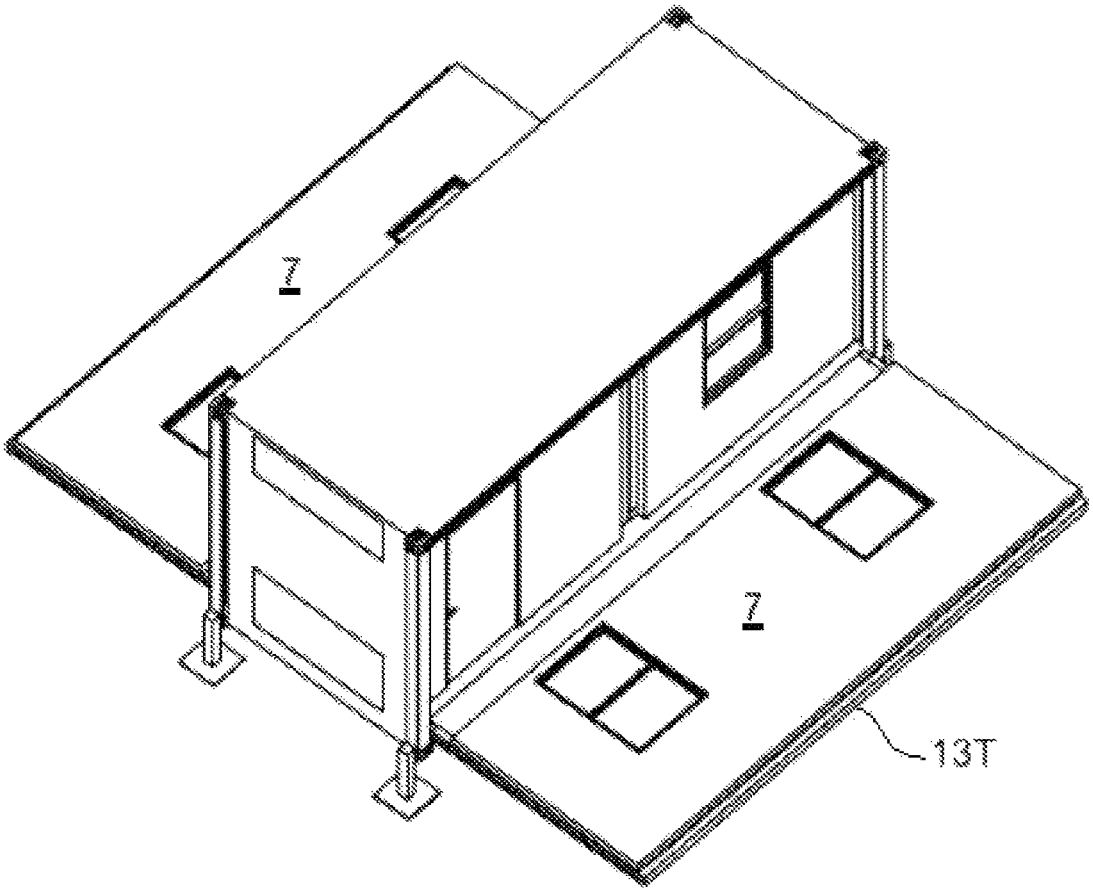
Figure 15:
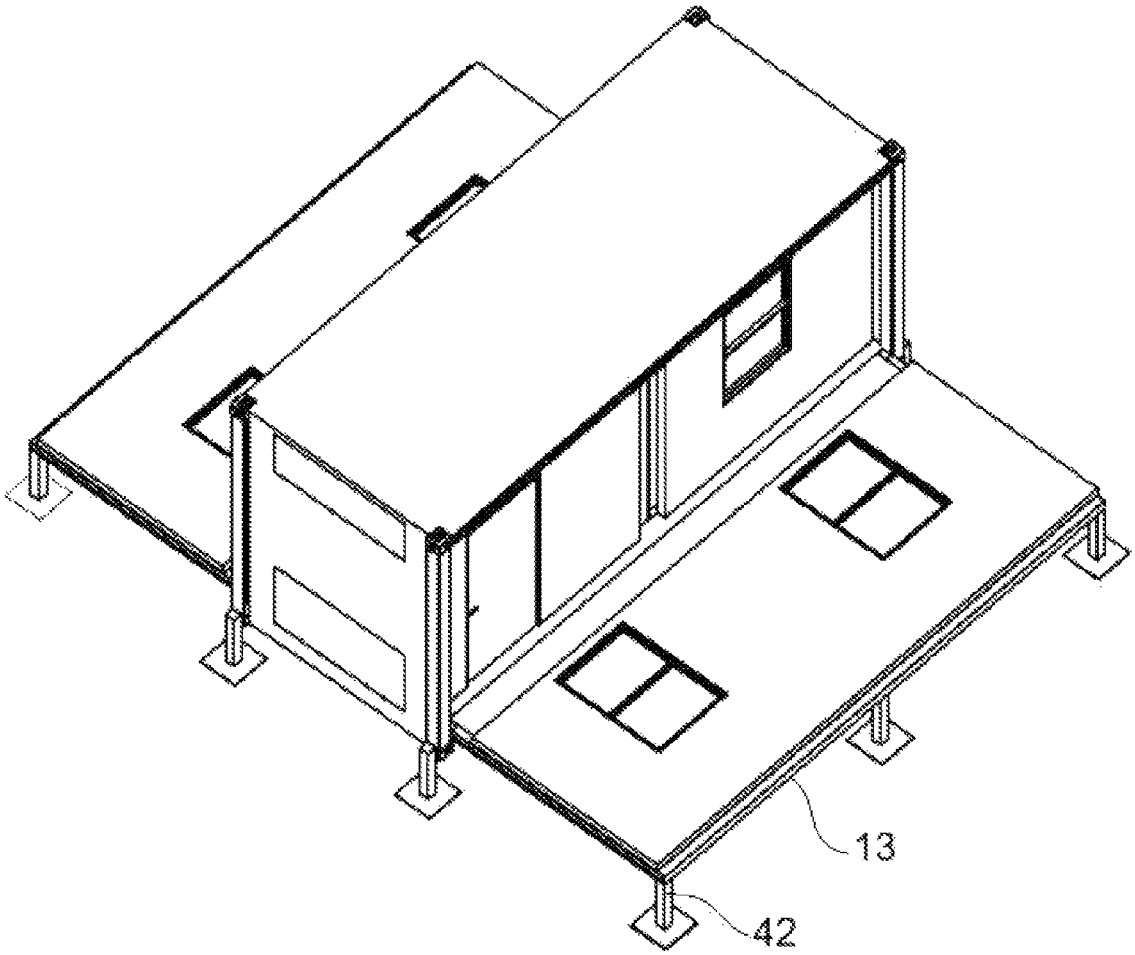

Turning to FIGS. 13 and 14, the first and second floor panels 13 are pivoted outwardly in opposite directions such that each assumes a horizontal orientation (FIG. 14) with the top end 13T of each disposed away from an opposite transverse side 30T of the container floor section 30. An upper surface 28 of each floor panel 13 may be substantially flush with an upper surface of the container floor section 30, as shown in FIG. 5C. Referring to FIGS. 5A-5C, pivot hinges 15 may facilitate rotation of the floor panels 13 from the vertical position the horizontal position. In some embodiments, the rotating floor hinging system includes an L-shaped steel bracket 21 with an attached steel rod 22 which is utilized to attach the floor panel 13 to the frame 1 (L e., to the container floor section 30). A steel angle 23 may extend the entire longitudinal length of the floor panel 13 and may be attached to an aluminum frame 24 of the floor panel 13. A steel bracket 25 may be attached to the steel angle 23, with the steel bracket configured to accept a bushing 26 sized and configured to accept a steel rod 22 attached to the main framework 1 and/or the pivot hinge 15. The steel angle 23 is shown offset from the aluminum tube frame 24 of the floor panel 13 at a precise location so that the pivoting floor panel 13 will create a seal with a top portion of the container floor portion 30 in the vertical and, in the horizontal position, will create a flush coplanar seal between the upper surface 28 of the floor panel 13 and the upper surface of the container floor portion 30. Referring to FIG. 15, in some embodiments, one or more legs 42 may be positioned to support a lower surface of the floor panels 13. The legs 42 may be identical or similar to the legs 40 described above; for example, the legs 42 may be height-adjustable.

Figure 16:
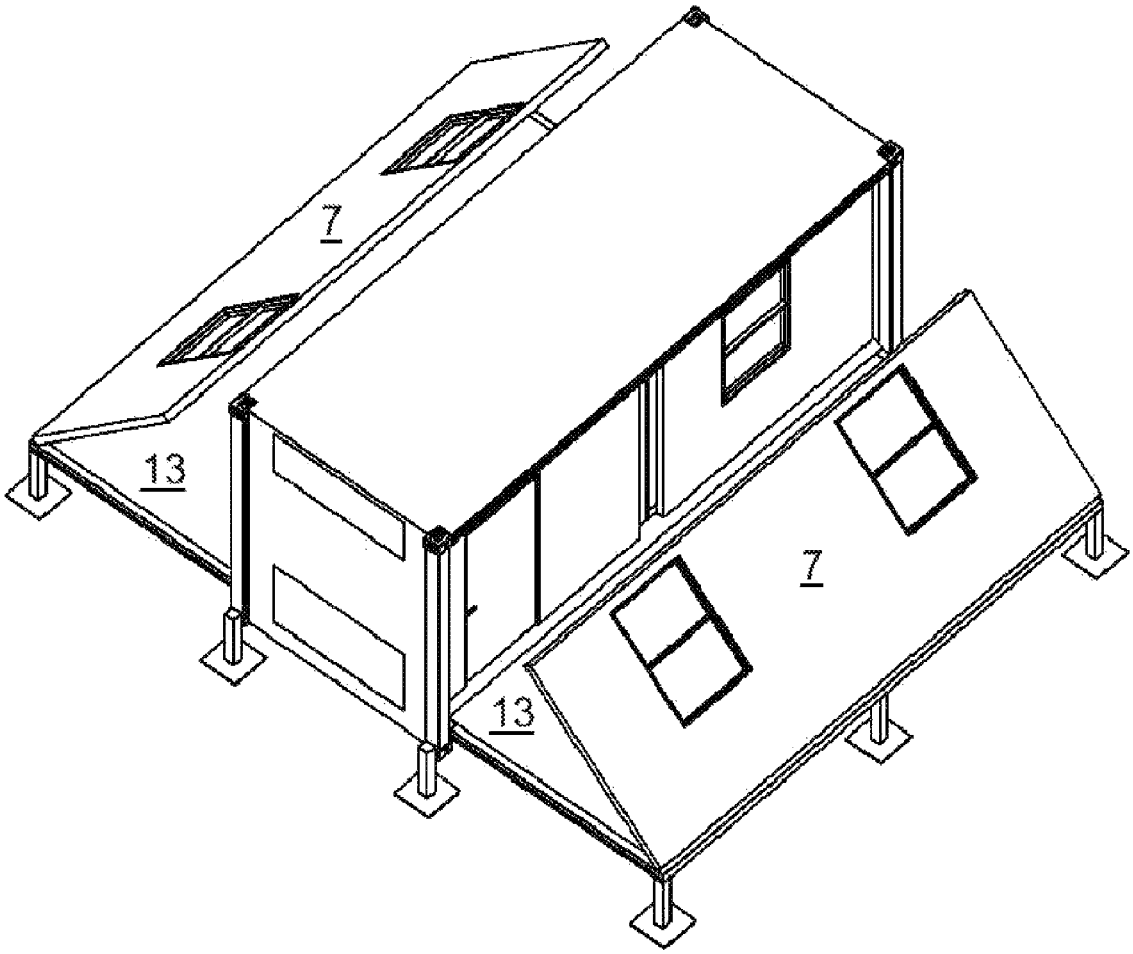
Figure 17:
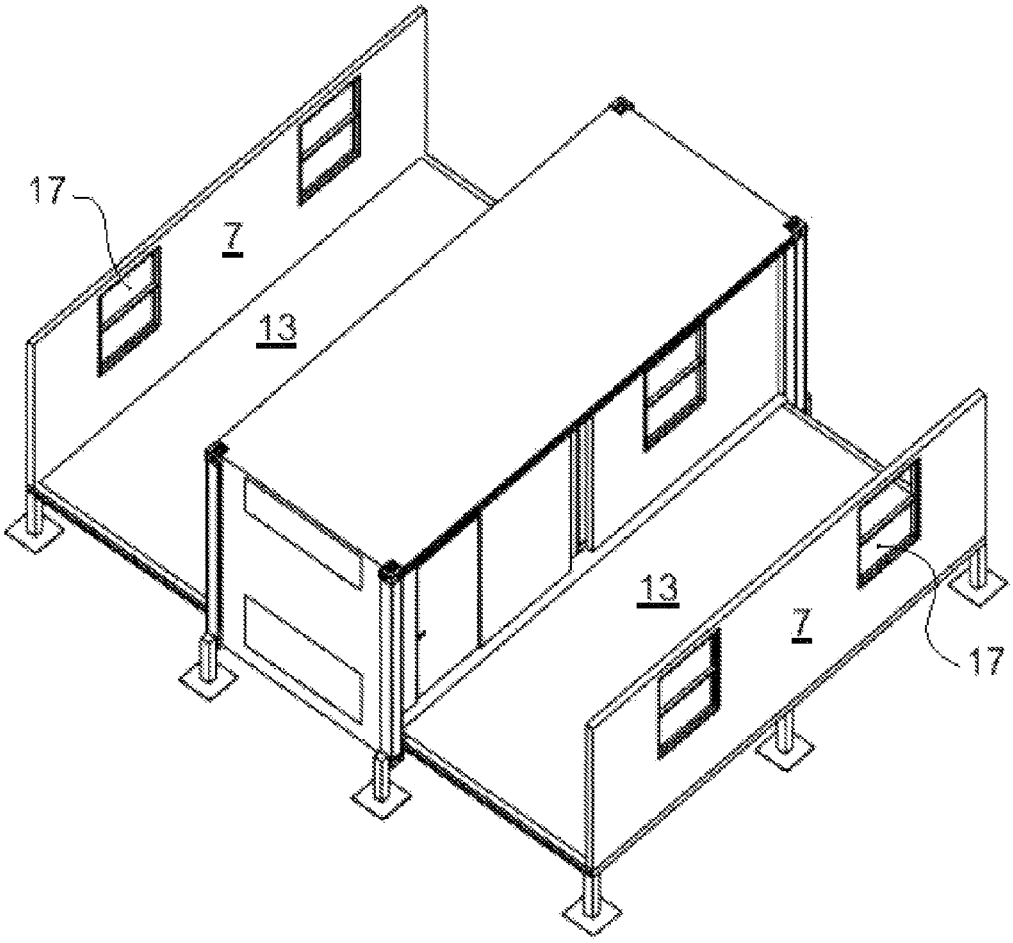

Turning now to FIGS. 16 and 17, as the assembly is moved to the expanded habitable state, each of the first and second exterior side wall panels 7 is pivoted upwardly to form a vertical exterior wall of the structure. In some embodiments, box hinges 29 (FIGS. 3 and 4) are configured to retain the first and second exterior side wall panels 7 in a vertical orientation. As shown in FIG. 17, one or both of the first and second exterior side wall panels 7 includes at least one window 17 (e.g., an ADA-compliant window). In some embodiments, and as illustrated, each of the exterior side wall panels includes a plurality of ADA-compliant windows 17.

Figure 18:
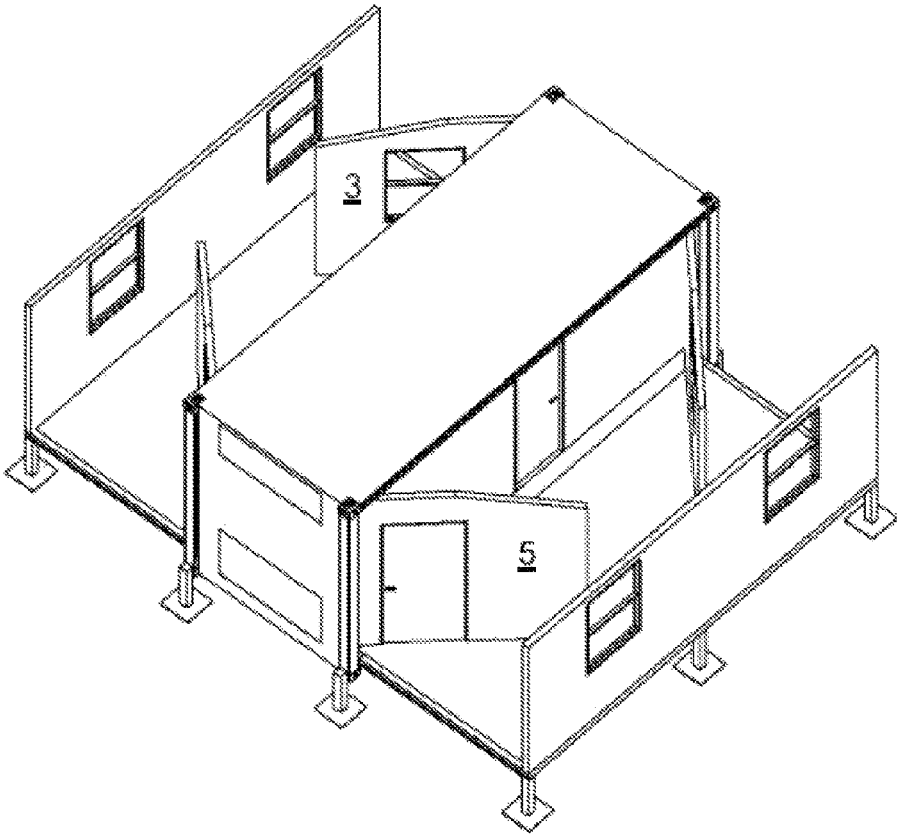
Figure 19:
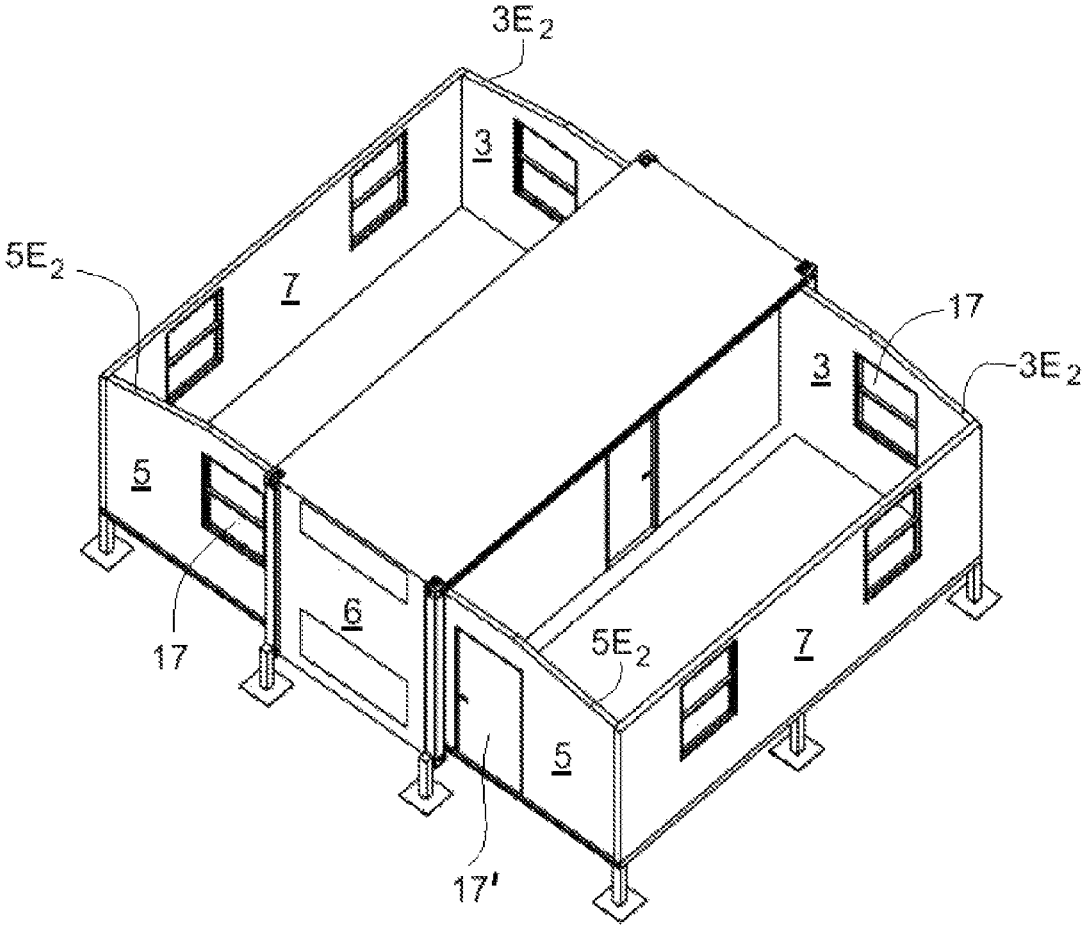

Continuing to FIGS. 18 and 19, as the assembly is moved to the expanded habitable state, each of the first and second exterior end wall panels 3 and the third and fourth exterior end wall panels 5 are pivoted outwardly. In the expanded state, and as shown in FIG. 19, the first exterior end wall panel 3 is substantially parallel to the first container end section 6 and the second end $3E_2$ of the first exterior end wall panel 3 is adjacent or contacting the first exterior side wall panel 7. The second exterior end wall panel 3 is substantially parallel to the first container end section 6 with the second end $3E_2$ of the second exterior end wall panel 3 adjacent of contacting the second, opposite exterior side wall panel 7. The third exterior end wall panel 5 is substantially parallel to the second, opposite container end section 6 with the second end $5E_2$ of the third exterior end wall panel 5 adjacent or contacting the first exterior side wall panel 7. The fourth exterior end wall panel 5 is substantially parallel to the second container end section 6 with the second end $5E_2$ of the fourth exterior end wall panel adjacent or contacting the second exterior side wall panel. In some embodiments, in the expanded habitable state, the second end $3E_2$ of one of the first and second end wall panels 3 and the second end $5E_2$ of one of the third and fourth end wall panels 5 are each lockingly engaged with the first exterior side wall panel 7 at spaced-apart locations thereof, and the second end $3E_2$ of the other one of the first and second end wall panels 3 and the second end $5E_2$ of the other one of the third and fourth end wall panels 5 are each lockingly engaged with the second, opposite exterior side wall panel 7 at spaced-apart locations thereof.

Each of the exterior end wall panels 3, 5 may include a HUD-compliant window 17 and/or an ADA-compliant door 17'. As illustrated in FIG. 19, at least one of the exterior end wall panels 3, 5 includes an ADA-compliant door for ingress and egress with respect to the shelter.

Figure 20:
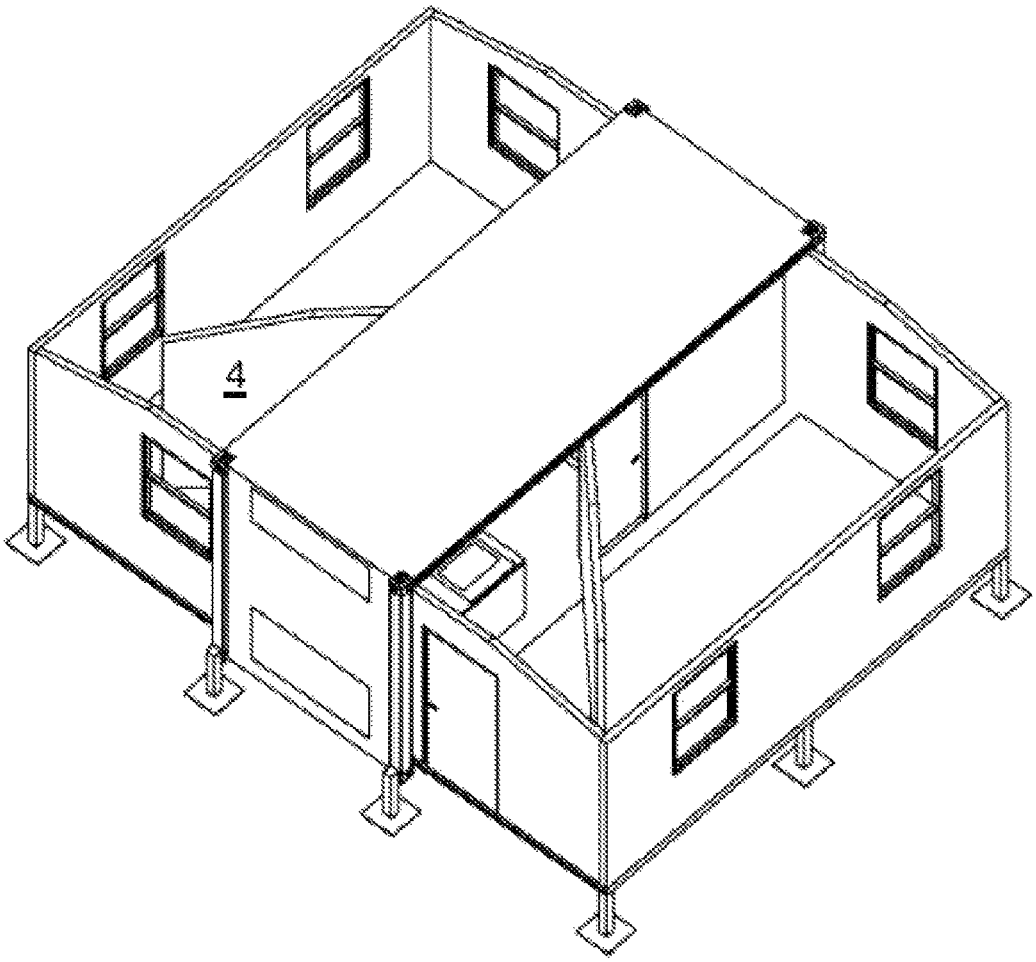
Figure 21:
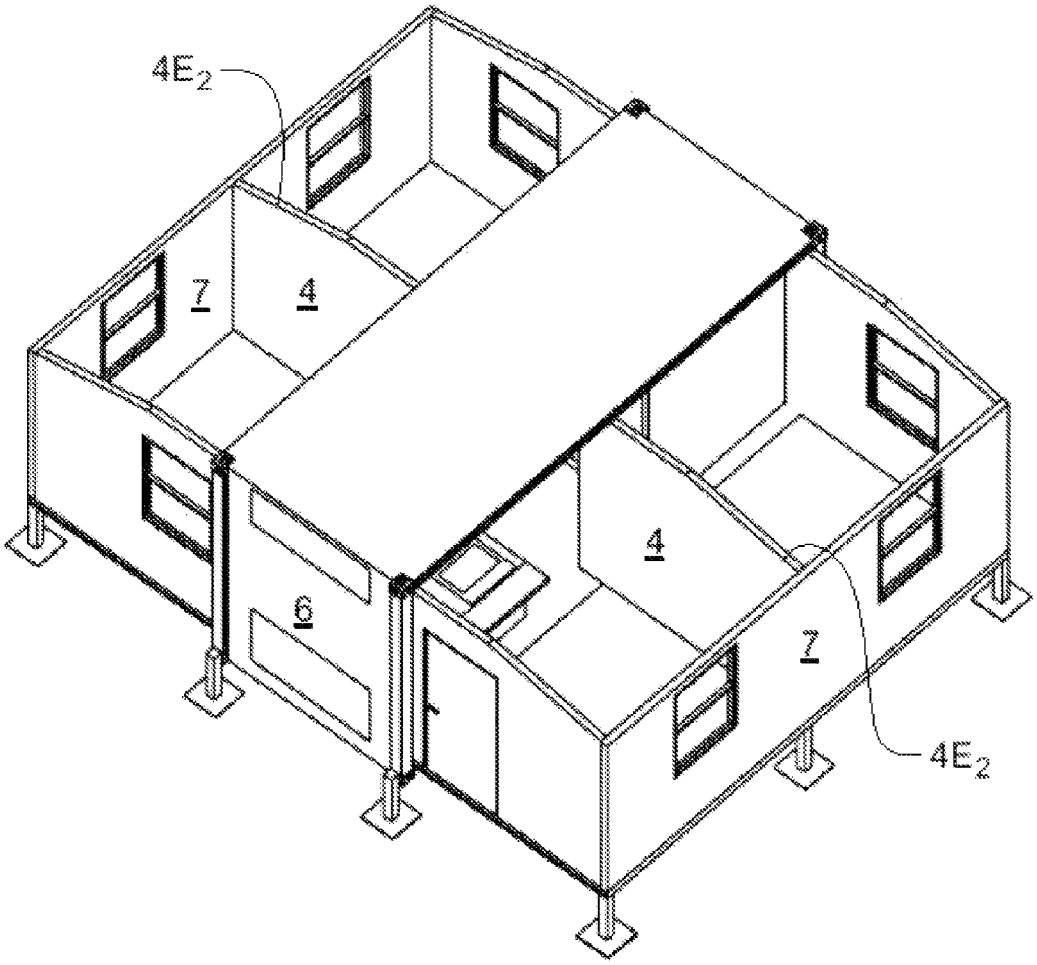

Referring now to FIGS. 20 and 21, as the assembly is moved to the expanded habitable state, the first pivotable interior wall panel 4 may be pivoted outwardly so as to be substantially parallel to the first and second container end sections 6 with the second end $4E_2$ of the first pivotable interior wall panel 4 adjacent or contacting the first exterior side wall panel 7. Similarly, the second pivotable interior wall panel 4 may be pivoted outwardly so as to be substantially parallel to the first and second container end sections 6 with the second end $4E_2$ of the second pivotable interior wall panel adjacent or contacting the second, opposite exterior side wall panel 7.

In some embodiments, the second end $4E_2$ of the first pivotable interior wall panel 4 is lockingly engaged with the first exterior side wall panel 7 and the second end $4E_2$ of the second pivotable interior wall panel 4 is lockingly engaged with the second, opposite exterior side wall panel 7.

Figure 22:
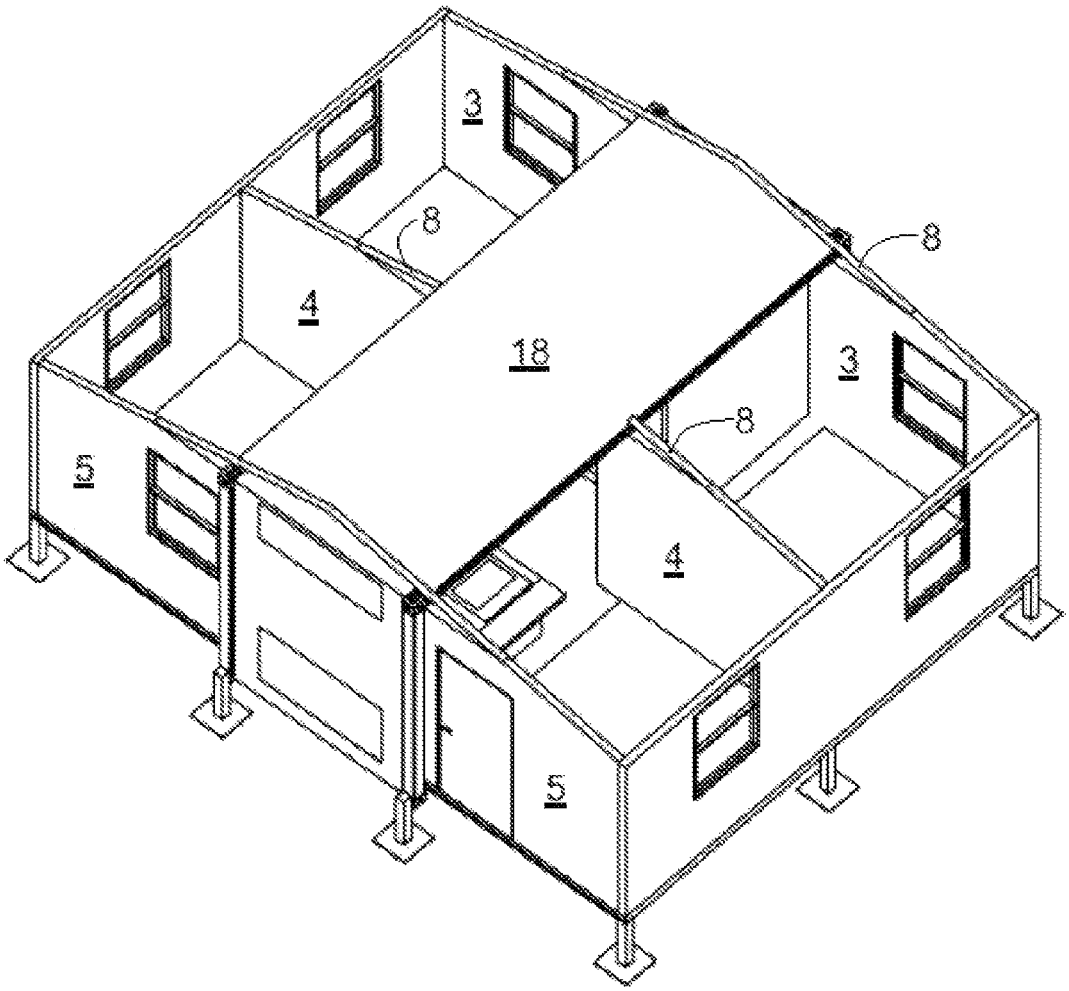

In some embodiments, and as shown in FIG. 22, one or more of the exterior end wall panels 3, 5 and the pivotable interior wall panels 4 includes a pivotable corner filler 8 that may be flipped up 180 degrees along a respective wall 3, 4, 5. The fillers 8 may be configured to fill what would otherwise be a void when insulated roofing panels 20 are installed, thereby creating a thermal seal between the climate-controlled interior habitable space and the outside elements.

Figure 24:
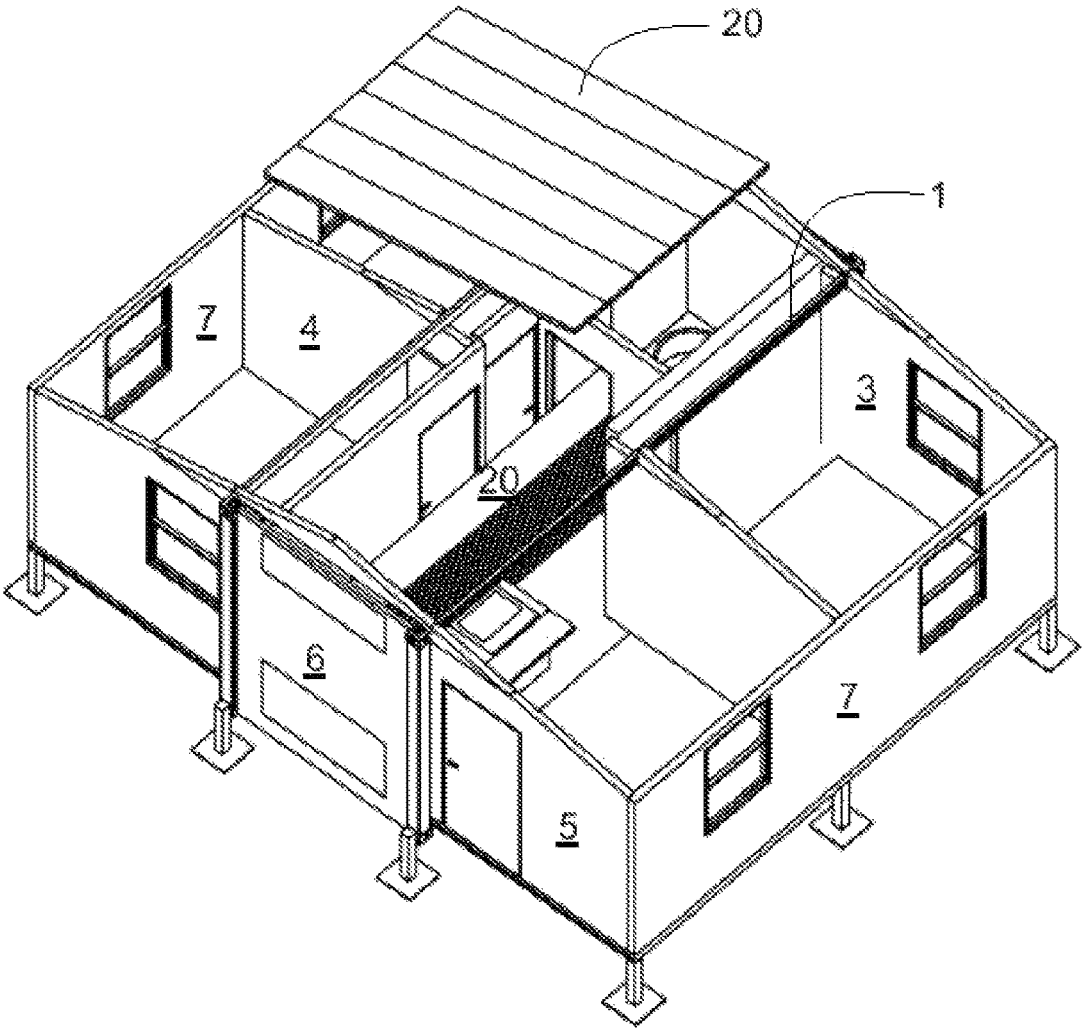
Figure 25:
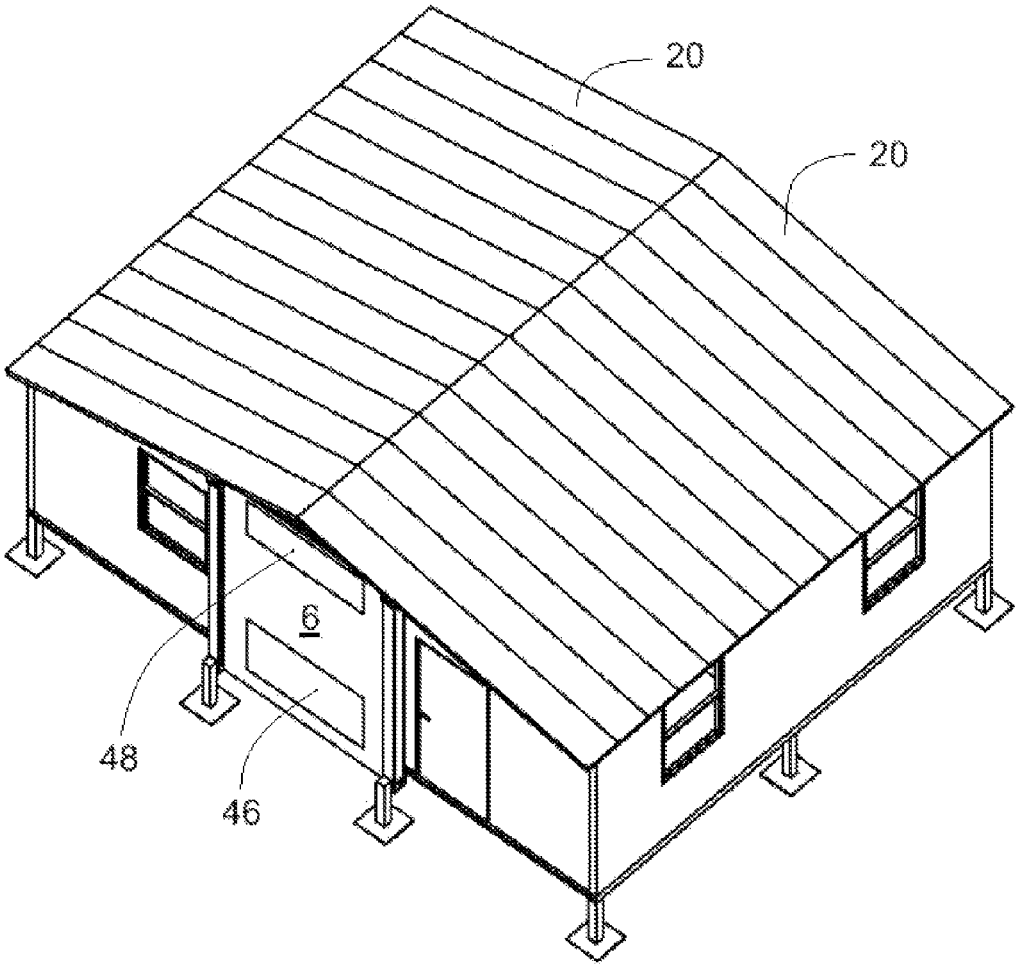

FIG. 23 illustrates the roofing panels 20 which may be stackingly held within the container. As noted above, the roof panels 20 are removably held in the interior cavity 32 (FIG. 2) when the assembly is in the closed container transportable state. In the expanded habitable state, and as shown in FIGS. 24-25, the roof panels 20 are attached to upper portions of the exterior side wall panels 7, the exterior end wall panels 3, 5, the pivotable interior wall panels 4, the frame 1 and/or the container roof section 18. Although the container roof section 18 is shown removed from FIGS. 22-23, it is contemplated that the container roof section 18 remain in place as the roof panels 20 are attached to complete the structure. It is also contemplated that the roof panels 20 could be attached in a different orientation (e.g., with the apex oriented 90 degrees from the configuration shown in FIG. 25).

Figure 26:
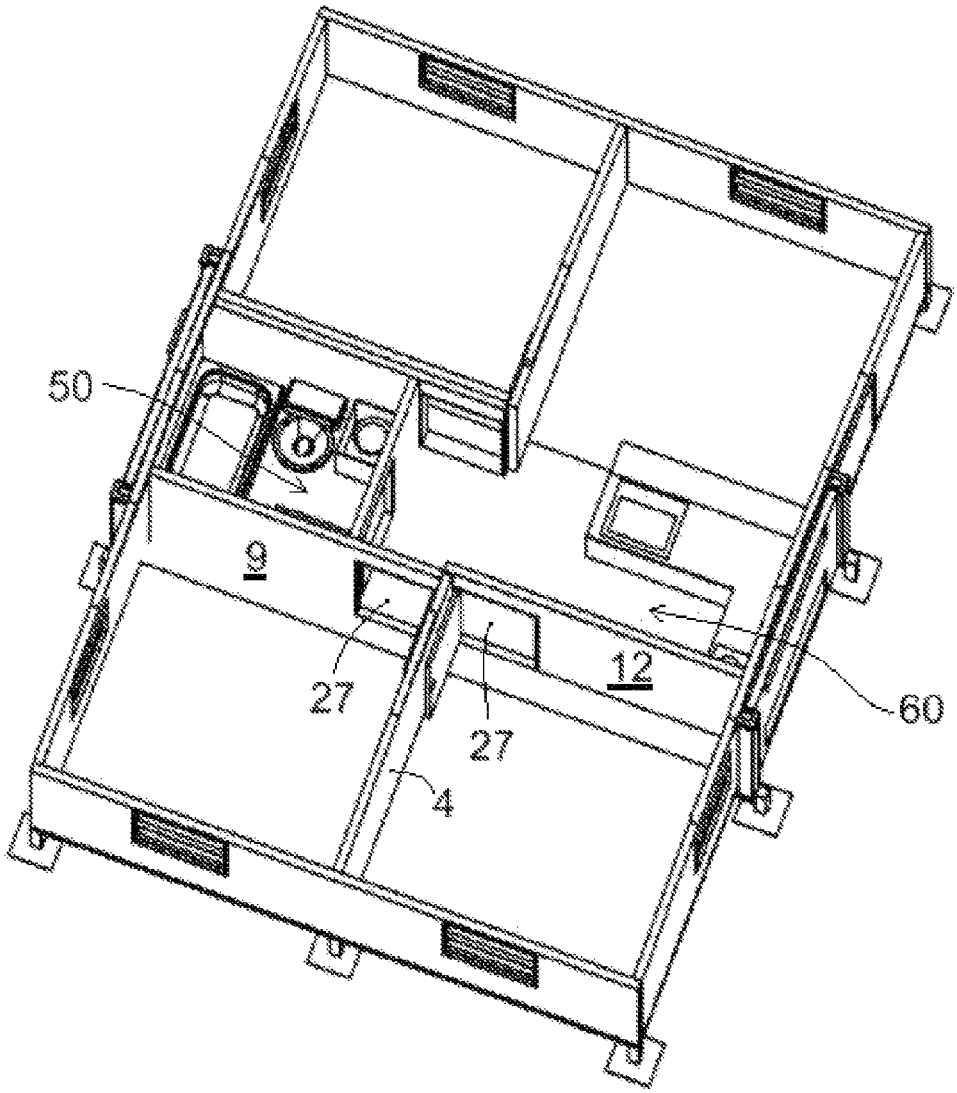
FIG. 26 is a top perspective view of a floor plan of the assembly of FIG. 1, with the assembly in an expanded state but with roofing panels removed.
Figure 27:
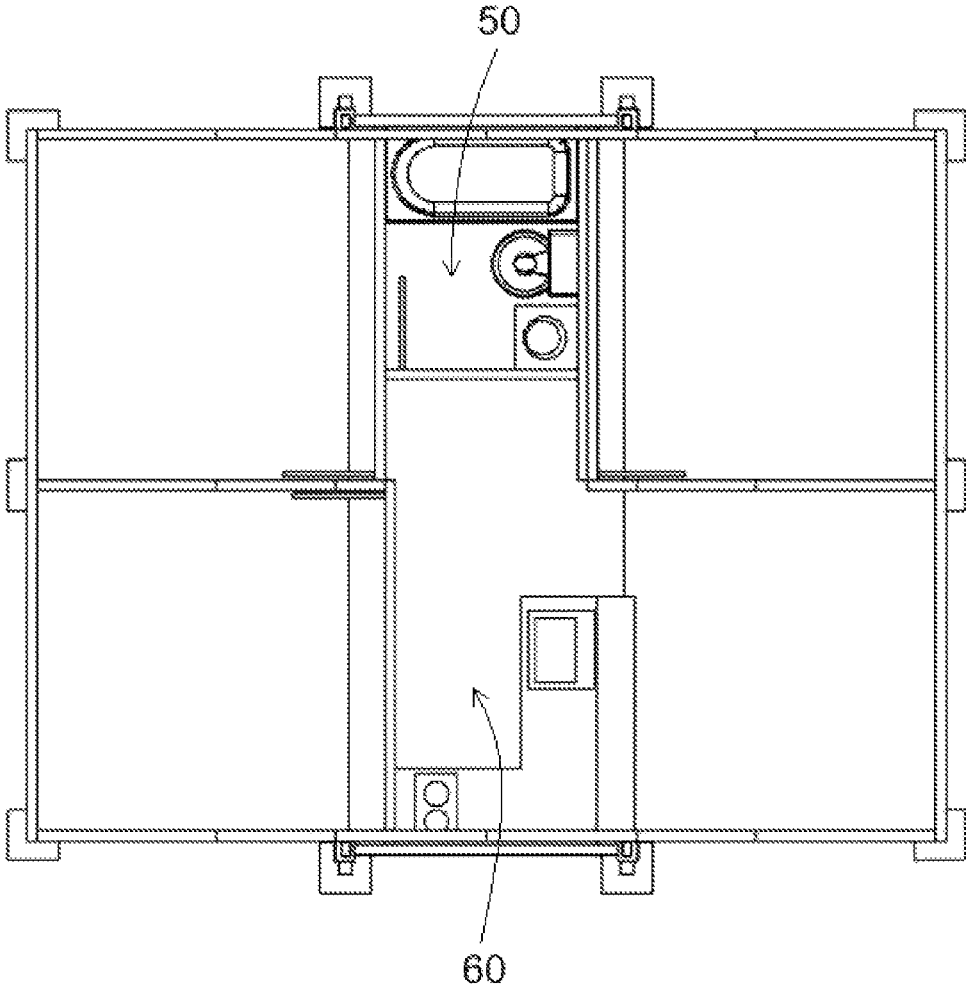
FIG. 27 is a top plan view of a floor plan of the assembly of FIG. 1, with the assembly in an expanded state but with roofing panels removed.

The interior of the structure is compartmentalized into areas that include a kitchen 60 (e.g., an ADA-compliant kitchen) and a bathroom 50 (e.g., an ADA-compliant bathroom) as shown in FIGS. 26 and 27. The kitchen 50 includes at least a refrigerator, a stove and a sink. The bathroom includes at least a sink, a toilet and a shower. Some of the fixed interior walls, such as walls 9, 10, 11, 12 shown in FIGS. 1 and 26, may include ADA-compliant doors. At least some of the pivotable interior walls 4 may be solid (i.e., without doors or other openings) to provide privacy.

The various walls of the structure are pre-wired and pre-plumbed and have provisions to connect with an appropriate central supply source for electricity and water. Referring to FIG. 25, at least one of the container end portions may include panels 46, 48. The panels 46, 48 may be manipulated or removed to allow for electrical, water and/or HVAC attachment.

According to some embodiments, the completed (expanded) structure meets the Department of Housing and Urban Development (HUD) requirements for housing, i.e., is HUD-certified, HUD-approved and/or is a HUD code structure. The Federal Emergency Management Agency (FEMA) and other emergency agencies now require for all emergency housing to be HUD-approved. Thus, embodiments of the invention provide for a container that complies with applicable rules and/or specification (e.g., an ISO-certified container) that may be reliably and safely transported and quickly deployed to provide a comforting and private dwelling with HUD certification for individuals and families who have very recently lost their homes due to any number of causes.

In some embodiments, the assemblies are built in a factory under a federal building code administered by HUD. The Federal Manufactured Home Construction and Safety Standards (commonly known as the HUD Code) went into effect Jun. 15, 1976. As noted above, FEMA now requires that emergency homes be compliant with HUD code. The structures may be transported to the site and installed. The federal standards regulate housing design and construction, strength and durability, transportability, fire resistance, energy efficiency and quality. The HUD Code also sets performance standards for the heating, plumbing, air conditioning, thermal and electrical systems. It is the only federally-regulated national building code.

Thus, certain HUD code structures are built in a factory, under controlled conditions, and a special label is affixed on the exterior of the home indicating that the home has been designed, constructed, tested and inspected to comply with the stringent federal standards set forth in the code. No home may be shipped from the factory unless it complies with the HUD code and is released for shipment by an independent third party inspector certified by HUD.

The HUD Code is unique since it is specifically designed for compatibility with the factory production process. Performance standards for heating, plumbing, air conditioning, thermal and electrical systems are set in the code. In addition, performance requirements are established for structural design, construction, fire safety, energy efficiency, and transportation from the factory to the end-user site (e.g., an emergency site). To ensure quality, the design and construction of the structure is monitored by both HUD and its monitoring contractor. The familiar red seal (the certification label) attached to the exterior of a structure indicates that it has undergone and passed perhaps the most thorough inspection process in the home building industry.

The present inventors have established a container that is ISO-certified and that includes dwelling components and members that, when expanded or otherwise manipulated, form a HUD code dwelling after transport to a remote location. The present invention addresses needs including those associated with disaster relief, military operations, and simply providing high-quality, temporary or semi-permanent structures for end-users. The certified shipping containers facilitate rapid deployment, which is especially important for disaster relief and military purposes. The dwelling members are easily manipulated (e.g., the walls may be moved to the habitable position by simple pulling and rotating). This further facilitates the rapid deployment and installation at the end-user site. The HUD certification ensures that the structure is comfortable and provides the amenities one would need for even extended occupancy.

Some embodiments of the invention are directed to methods for designing and building a collapsible structure using a certified container as a mainframe. With disasters on the rise, the world's requirement for emergency structures is at an all-time high. There are needs for homes, schoolrooms, food distribution centers, communication hubs and other shelters. In emergency situations, quick deployment is of the utmost importance. A structure which can unfold from a shipping container is an effective solution to meeting this need. As noted above, to transport containers by ship, rail, truck or plane, standards set by various organizations must be met for safety and handling. These organizations include ISO, IMO, CSC, the United States Coast Guard (USCG) and others. These organizations ensure that their standards are met by requiring a certification process that includes, but not limited to, engineered plans, certified fabrication and physical testing. Once certified, the container can ship anywhere in the world by standard means, quickly and safely. By providing certified containers that expand into habitable structures, these structures may be deployed to needed regions efficiently.

If a hole is cut into a container for a door or window or if any retrofitting or remodeling is done to the structure, the container loses certification and is not "cargo worthy" nor or does it meet other requirements for shipping and storage, such as stackabilty. This limits the transportation options and requires special handling, costing time, which can be the difference between meeting the needs of the disaster victims and possibly saving lives.

Embodiments of the present invention address these problems by providing processes which help ensure the containers remain certified and "cargo ready." According to embodiments of the invention, structures are designed with their main component being an iron main frame, such as the frame 1 described above. This main frame may be an existing certified container or it may be a newly designed container. Once the plans for the structure are complete, the plans for the container are engineered with all components of the structure attached, all cut outs complete and any special needs required for the structure addressed. The main frame may then be taken to test sites to go through a series of tests to complete the certification process and be deemed "cargo worthy." Once the physical testing is complete, the container may receive a plaque which may be installed on the outside of the container to ensure shippers that the container is compliant with the applicable standards (e.g., ISO-certified).

Thus, embodiments of the invention are directed to a process of designing a safe, habitable, easy transportable structure with a main frame as one of its most important structural components. The main frame, with all components attached or contained therewithin, is designed, engineered, tested and certified as a cargo worthy container. As noted above, this certification can be made by one or more of the following organizations including, but not limited to, ISO, CSC, IMO and the U.S. Coast Guard. Components or dwelling members are attached to or held within the certified container by means of specially designed and engineered hinges, pivot pins, slides, bolts/screws or other attachments which allow rotation and/or movement of at least some of the components. These connections allow all components of the structure (e.g., the dwelling members described above) to either collapse into or placed in the cargo space or cavity of the main frame container, thus meeting all certification requirements for transportation.

The type of structure needed is first established. For example, the structure may be an emergency home, a school, a medical care center, and so forth. A determination may then be made as to whether an existing container is suitable or whether a new main frame should be designed based on the need.

Next, the structure is designed using the container as the main frame. Among other things, the container as the main frame sets the length and height of the structure as well as the useable area for folding components or dwelling members into and space for storage. There may need to be a fixed space or a center core in the cavity of the container to accommodate plumbing, electrical, heating and cooling components, for example. A determination is also required as to which dwelling members are to be fixed, detachable, and which are to be configured for collapsing and/or rotation.

Next, the main frame is designed/engineered and certified container plans are established. The main frame acts as the main structural component to which every other component is attached, and is also required to meet the requirements and testing as an certified container once all other components are attached, folded up and/or stored in transportation mode. A desired certification for the completed container is selected and all required standards are incorporated into the design. The container or main frame is tested to determine whether the design complies with the standards. Plans may be submitted to the selected governing body for approval to build. The plans, engineering design and specifications are first approved by the governing body for fabrication of the container. Each entity has a different process, and depending on which standard is chosen, the process will vary somewhat, but all require physical testing.

The next step is testing and certification of the container. To accomplish this task, the plans have been approved for fabrication and the container is built according to them and the specifications. Some governing bodies require an inspector to be present during fabrication, some require just spot inspections throughout fabrication, and still others do not require any inspections through fabrication. Once completed, the container is delivered to a certified testing center for physical testing. Again, the container will be subjected to various testing depending on the selected standards and desired certification. Once all tests have been completed and passed, the container is certified and registered for transportation.

With the transportation element of the structure complete, the structure may be designed/engineered as a completed shelter ready for use. First, a desired or required building standard is selected. This may be a self imposed standard or a required standard: either way it, will establish the limits to be met in the engineering of the structure, e.g., the selection the materials and connections for dwelling members to provide sufficient strength to hold up to floor loads, wind factors and so forth. The process for obtaining HUD certification is described above.

Many alterations and modifications may be made by those having ordinary skill in the art, given the benefit of present disclosure, without departing from the spirit and scope of the invention. Therefore, it must be understood that the illustrated embodiments have been set forth only for the purposes of example, and that it should not be taken as limiting the invention as defined by the following claims. The following claims, therefore, are to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the invention.

That which is claimed is:

1. A container/shelter assembly expandable from a closed container transport state to an expanded habitable state, the assembly comprising:

a container frame, comprising:

a horizontal container floor section and an opposed horizontal container roof section;

a first vertical container end section and a second, opposed vertical container end section; and four vertically-extending container corner members;

a first floor panel having a horizontally-extending bottom end and a horizontally-extending top end, the bottom end pivotally connected to a first transverse side of the container floor section;

a second floor panel having a horizontally-extending bottom end and a horizontally-extending top end, the bottom end pivotally connected to a second, opposite transverse side of the container floor section;

a first exterior side wall panel pivotally connected to the top end of the first floor panel and a second exterior side wall panel pivotally connected to the top end of the second floor panel;

first, second, third and fourth exterior end wall panels, each exterior end wall panel having first and second opposing vertically-extending ends, the first end of each of the first and second exterior end wall panels pivotally connected to the container frame adjacent the first container end section and a respective one of the container corner members, the first end of each of the third and fourth exterior end wall panels pivotally connected to the container frame adjacent the second container end section and a respective one of the container corner members, wherein each of the first, second, third and fourth vertical exterior end wall panels has a top edge that has a flat portion; and a plurality of roof panels;

wherein, in the closed container transport state:

each of the first and second floor panels are oriented vertically such that the top end of the first floor panel is adjacent a first transverse side of the container roof section and the top end of the second floor panel is adjacent a second, opposite transverse side of the container roof section, and such that the first and second container end sections, the first and second floor panels, the container floor section and the container roof section define an internal cavity;

the first and second exterior side wall panels, the first, second, third and fourth exterior end wall panels, and the first and second vertical interior wall panels are disposed within the internal cavity; and the roof panels are removably held in the internal cavity;

wherein, in the expanded habitable state:

the first and second floor panels are pivoted outwardly in opposite directions such that each assumes a horizontal orientation with the top end of each disposed away from an opposite transverse side of the container floor section;

the first and second exterior side wall panels are pivoted such that each is oriented vertically;

the first and second exterior end wall panels are pivoted in opposite directions such that each extends away from and is substantially parallel to the first container end section; and the third and fourth exterior end wall panels are pivoted in opposite directions such that each extends away from and is substantially parallel to the second container end section;

a first triangle-shaped member is positioned on a top edge of the first vertical end section of the container frame and a second triangle-shaped member is positioned on a top edge of the second vertical end section of the container frame;

a wedge-shaped filler member is positioned on the top edge of each of the first, second, third and fourth exterior end wall panels at the flat portion, wherein a first wedge-shaped filler member is positioned on the top edge of the first exterior end wall panel on one side of the first triangle-shaped member to form a roof panel mounting surface that has a constant slope, a second wedge-shaped filler member is positioned on the top edge of the second exterior wall panel on a second, opposite side of the first triangle-shaped member to form a roof panel mounting surface that has a constant slope, a third wedge-shaped filler member is positioned on the top edge of the third exterior wall panel on a first side of the second triangle-shaped member to form a roof panel mounting surface that has a constant slope, and a fourth wedge-shaped filler member is positioned on the top edge of the fourth exterior wall panel on a second, opposite side of the second triangle-shaped member to form a roof panel mounting surface that has a constant slope; and the roof panels are attached to upper portions of the exterior side wall panels, the exterior end wall panels and the roof panel mounting surfaces defined by the triangle-shaped members and the filler members.

2. The assembly of claim 1, wherein, when the first and second floor panels are pivoted outwardly in opposite directions such that each assumes a horizontal orientation with the top end of each disposed away from an opposite transverse side of the container floor section, an upper surface of each floor panel is substantially flush with an upper surface of the container floor section.

3. The assembly of claim 1, wherein each corner member includes an ISO-certified corner fitting at a top and bottom portion thereof.

4. The assembly of claim 1, wherein the first exterior side wall panel is pivotally connected to the top end of the first floor panel via at least one first box hinge and the second exterior side wall panel is pivotally connected to the top end of the second floor panel via at least one box hinge, wherein, in the expanded habitable state, the first and second box hinges are configured to retain the first and second exterior side walls in a vertical orientation.

5. The assembly of claim 1, wherein, in the closed container state, the first and second exterior end wall panels are oriented substantially perpendicular to the first container end section and the third and fourth exterior end wall panels are oriented substantially perpendicular to the second container end section, and wherein, in the expanded habitable state, each of the exterior end wall panels is pivoted outwardly such that:

the first exterior end wall panel is substantially parallel to the first container end section with the second end of the first exterior end wall panel adjacent the first exterior side wall panel;

the second exterior end wall panel is substantially parallel to the first container end section with the second end of the second exterior end wall panel adjacent the second exterior side wall panel;

the third exterior end wall panel is substantially parallel to the second container end section with the second end of the third exterior end wall panel adjacent the first exterior side wall panel; and the fourth exterior end wall panel is substantially parallel to the second container end section with the second end of the fourth exterior end wall panel adjacent the second exterior side wall panel.

6. The assembly of claim 5, wherein, in the expanded habitable state:

the second ends of the first and third exterior end wall panels are each lockingly engaged with the first exterior side wall panel at spaced-apart locations thereof; and the second ends of the second and fourth exterior end wall panels are each lockingly engaged with the second exterior side wall panel at spaced-apart locations thereof.

7. The assembly of claim 1, wherein the at least some of the exterior end wall panels include at least one of an ADA-compliant window and an ADA-compliant door.

8. The assembly of claim 1, further comprising first and second pivotable interior wall panels, each having first and second opposed vertically-extending ends, the first end of the first pivotable interior wall panel pivotally connected to the first transverse side of at least one of the container floor section and the container roof section, the first end of the second pivotable interior wall panel pivotally connected to the second transverse side of at least one of the container floor section and the container roof section, wherein each of the first and second pivotable interior wall panels has a top edge that has a flat portion, wherein, in the closed container state the first and second pivotable interior wall panels are substantially perpendicular to the first and second container end sections, and wherein, in the expanded habitable state:

the first pivotable interior wall panel is pivoted outwardly so as to be substantially parallel to the first and second container end sections with the second end of the first pivotable interior wall panel adjacent the first exterior side wall panel;

the second pivotable interior wall panel is pivoted outwardly so as to be substantially parallel to the first and second container end sections with the second end of the second pivotable interior wall panel adjacent the second exterior side wall panel; and a wedge-shaped filler member is positioned on the top edge of each of the first and second pivotable interior wall panels at the flat portion to form a roof panel mounting surface that has a constant slope before the roof panels are attached.

9. The assembly of claim 1, wherein plurality of dwelling members comprises a plurality of fixed interior walls, each of the fixed interior walls fixedly attached to the container floor section, wherein at least some of the fixed interior walls are oriented substantially perpendicular to the first and second container end sections, wherein at least some of the fixed interior walls are oriented substantially parallel to the first and second container end sections, and wherein at least some of the interior walls include an ADA-compliant doorway.

10. The assembly of claim 1, wherein, in the closed transportable container state, the assembly is a sealed ISO-certified container having dimensions of 8 feet wide, 9 feet, six inches tall, and 20, 30 or 40 feet long.

11. The assembly of claim 10, wherein, in the closed transportable state, the container has an ISO-certified plaque attached thereto, and wherein, in the expanded habitable state, the assembly is a HUD-certified structure that has a HUD code seal attached thereto.

12. The assembly of claim 1, wherein at least some of the frame, the first and second floor panels, the exterior side wall panels and the exterior end wall panels are pre-wired and/or pre-plumbed, and wherein the assembly includes provisions to connect with a supply source for electricity and/or water.

13. The assembly of claim 1, wherein, in the closed container transport state, the assembly is an ISO-certified container.

14. The assembly of claim 1, wherein, in the expanded habitable state, the assembly is a HUD-certified structure.

15. A method for rapidly deploying and erecting a structure, the method comprising:

providing a container comprising:

a container frame including a horizontal floor section, an opposed horizontal roof section and first and second opposed vertical end sections;

a pair of opposed vertically-disposed floor panels, wherein each floor panel has a top end and a bottom end, wherein the bottom end of each floor panel is pivotally connected to a respective opposite lateral side portion of the container frame floor section, wherein the container frame and the opposed floor panels define an interior cavity with a plurality of dwelling members disposed therein, the plurality of dwelling members comprising:

a first exterior side wall panel pivotally connected to the top end of the first floor panel and a second exterior side wall panel pivotally connected to the top end of the second floor panel;

first and second exterior end wall panels pivotally connected to the container frame adjacent the first vertical end section and third and fourth exterior end wall panels pivotally connected to the container frame adjacent the second vertical end section, wherein each of the first, second, third and fourth vertical exterior end wall panels has a top edge that has a flat portion; and a plurality of roofing panels releasably held in the interior cavity of the container;

transporting the container to a desired location; and forming a structure at the desired location, wherein forming the structure comprises manipulating at least some of the dwelling members including:

pivoting the top ends of the floor panels downward and outward such that each floor panel is oriented horizontally and each floor panel top end is spaced-apart from a respective one of the opposite lateral sides of the container frame floor section;

pivoting the first exterior side wall panel upwardly from the top end of the horizontally disposed first floor panel and pivoting the second exterior side wall panel upwardly from the top end of the horizontally disposed second floor panel such that the first and second exterior side wall panels are vertically disposed; then pivoting the first and second exterior end wall panels outwardly in opposite directions such that a distal end of the first exterior end wall panel is adjacent the first exterior side wall panel and a distal end of the second exterior end wall panel is adjacent the second exterior side wall panel;

pivoting the third and fourth exterior end wall panels outwardly in opposite directions such that a distal end of the third exterior end wall panel is adjacent the first exterior side wall panel and a distal end of the fourth exterior end wall panel is adjacent the second exterior side wall panel;

positioning a first triangle-shaped member on a top edge of the first vertical end section of the container frame and positioning a second triangle-shaped member on a top edge of the second vertical end section of the container frame;

positioning a wedge-shaped filler member on the top edge of each of the first, second, third and fourth exterior end wall panels at the flat portion, including positioning a first wedge-shaped filler member on the top edge of the first exterior end wall panel on one side of the first triangle-shaped member to form a roof panel mounting surface that has a constant slope, positioning a second wedge-shaped filler member on the top edge of the second exterior wall panel on a second, opposite side of the first triangle-shaped member to form a roof panel mounting surface that has a constant slope, positioning a third wedge-shaped filler member on the top edge of the third exterior wall panel on a first side of the second triangle-shaped member to form a roof panel mounting surface that has a constant slope, and positioning a fourth wedge-shaped filler member on the top edge of the fourth exterior wall panel on a second, opposite side of the second triangle-shaped member to form a roof panel mounting surface that has a constant slope; and then attaching the roof panels to upper portions of the exterior side wall panels, the exterior end wall panels and the roof panel mounting surfaces defined by the triangle-shape members and the filler members.

16. The method of claim 15, wherein providing the container comprises providing an ISO-certified container, wherein transporting the container comprises transporting the ISO-certified container, and wherein forming the structure comprises forming a HUD-certified structure, the method further comprising:

obtaining ISO certification for the container prior to providing the ISO-certified container; and obtaining HUD approval of the container and the dwelling members disposed therein prior to transporting the ISO-certified container.

17. The method of claim 16, wherein the ISO-certified container has an ISO-certified plaque attached thereto.

18. The method of claim 15, wherein the plurality of dwelling members comprises a first pivotable interior wall panel pivotally connected to at least one of the first lateral side of the container frame floor and the first lateral side the container frame roof and a second pivotable interior wall panel pivotally connected to at least one of the second lateral side of the container frame floor and the second lateral side of the container frame roof, wherein each of the first and second pivotable interior wall panels has a top edge that has a flat portion.

19. The method of claim 18, wherein manipulating the plurality of dwelling members includes pivoting the first pivotable interior wall panel outwardly such that a distal end thereof is adjacent the first exterior side wall panel and pivoting the second pivotable interior wall panel outwardly such that a distal end thereof is adjacent the second exterior side wall panel; and positioning a wedge-shaped filler member on the top edge of each of the first and second pivotable interior wall panels at the flat portion to form a roof panel mounting surface that has a constant slope prior to attaching the roof panels.

20. The method of claim 19, wherein manipulating the plurality of dwelling members includes:

fixedly engaging the distal end of the first exterior end wall panel to the first exterior side wall panel and/or the first floor panel and fixedly engaging the distal end of the second exterior end wall panel to the second exterior side wall panel and/or the second floor panel;

fixedly engaging the distal end of the third exterior end wall panel to the first exterior side wall panel and/or the first floor panel and fixedly engaging the distal end of the fourth exterior end wall panel to the second exterior side wall panel and/or the second floor panel;

fixedly engaging the distal end of the first pivotable interior wall panel to the first exterior side wall panel and/or the first floor panel and fixedly engaging the distal end of the second pivotable interior wall panel to the second exterior side wall panel and/or the second floor panel; and fixedly attaching the roof panels to upper portions of the exterior side wall panels, the exterior end wall panels and the filler members.

* * * * *